US011131507B2

(12) United States Patent
Bugler, III et al.

(10) Patent No.: US 11,131,507 B2
(45) Date of Patent: Sep. 28, 2021

(54) HYBRID HEAT EXCHANGER APPARATUS AND METHOD OF OPERATING THE SAME

(71) Applicant: EVAPCO, INC., Westminster, MD (US)

(72) Inventors: Thomas W. Bugler, III, Frederick, MD (US); Davey J. Vadder, Westminster, MD (US)

(73) Assignee: Evapco, Inc., Taneytown, MD (US)

( * ) Notice: Subject to any disclaimer, the term of this patent is extended or adjusted under 35 U.S.C. 154(b) by 1305 days.

(21) Appl. No.: 14/630,096

(22) Filed: Feb. 24, 2015

(65) Prior Publication Data

US 2015/0168073 A1 Jun. 18, 2015

Related U.S. Application Data

(62) Division of application No. 12/885,083, filed on Sep. 17, 2010, now abandoned.

(51) Int. Cl.
*F28D 1/04* (2006.01)
*F28D 3/02* (2006.01)
(Continued)

(52) U.S. Cl.
CPC ..... *F28D 3/02* (2013.01); *F24F 5/0035* (2013.01); *F28C 1/14* (2013.01); *F28C 1/16* (2013.01); *F28D 5/02* (2013.01); *F28C 2001/145* (2013.01); *F28D 1/0417* (2013.01); *F28D 1/0461* (2013.01); *F28D 1/0477* (2013.01); *F28D 1/05316* (2013.01)

(58) Field of Classification Search
CPC .. F24F 5/0035; F28C 1/14; F28C 1/16; F28C 2001/145; F28D 1/0417; F28D 3/02; F28D 5/02
USPC ..... 165/113, 122, 60, 900, 110, 117, 285, 165/299; 261/138, 151, 152, 153; 62/305, 310, 311
See application file for complete search history.

(56) References Cited

U.S. PATENT DOCUMENTS 2,371,720 A 3/1945 Stine
2,890,864 A 6/1959 Stutz
(Continued)

OTHER PUBLICATIONS

PCT/US2011/043552 Notification of Transmittal of the International Search Report and the Written Opinion of the International Searching Authority, or Declaration dated Dec. 5, 2011. Forms PCT/ISA/220—PCT/ISA/210—PCT/ISA/237.
(Continued)

*Primary Examiner* — Leonard R Leo
(74) *Attorney, Agent, or Firm* — Whiteford, Taylor & Preston, LLP; Peter J. Davis

(57) ABSTRACT

A hybrid heat exchanger apparatus having a heat exchanger device with a hot fluid flowing therethrough includes a cooling water distribution system and an air flow mechanism for causing ambient air to flow across the heat exchanger device. The cooling water distribution system distributes evaporative cooling water onto the heat exchanger device to wet only a portion of the heat exchanger device while allowing a remaining portion of the heat exchanger device to be dry. The air flow mechanism causes ambient air to flow across the heat exchanger device to generate hot humid air from the ambient air flowing across the wet portion of the heat exchanger device and hot dry air from the ambient air flowing across the remaining dry portion of the heat exchanger device. Methods are also described.

9 Claims, 19 Drawing Sheets

(51) Int. Cl.

| | |
|---|---|
| ***F28D 5/02*** | (2006.01) |
| ***F28C 1/14*** | (2006.01) |
| ***F28C 1/16*** | (2006.01) |
| ***F24F 5/00*** | (2006.01) |
| *F28D 1/053* | (2006.01) |
| *F28D 1/047* | (2006.01) |

(56) References Cited

U.S. PATENT DOCUMENTS

| | | | |
|---|---|---|---|
| 3,148,516 | A | 9/1964 | Kals |
| 3,325,401 | A | 6/1967 | Lancy |
| 3,340,888 | A | 9/1967 | Farison |
| 3,595,786 | A | 7/1971 | Horvath et al. |
| 3,865,911 | A | 2/1975 | Lefevre |
| 3,903,213 | A | 9/1975 | Stover |
| 4,236,574 | A | 12/1980 | Bosne |
| 4,252,752 | A | 2/1981 | Flandroy |
| 4,315,873 | A | 2/1982 | Smith et al. |
| 4,337,216 | A | 6/1982 | Korsell |
| 4,427,607 | A | 1/1984 | Korsell |
| 4,443,389 | A | 4/1984 | Dodds |
| 4,448,211 | A | 5/1984 | Yoshida |
| 4,626,387 | A | 12/1986 | Dodds |
| 4,759,907 | A | 7/1988 | Kawolics et al. |
| 5,084,217 | A | 1/1992 | Dodds |
| 5,218,983 | A | 6/1993 | King |
| 5,595,201 | A | 1/1997 | Dobrez et al. |
| 5,724,828 | A | 3/1998 | Korenic |
| 5,816,318 | A | 10/1998 | Carter |
| 6,142,219 | A | 11/2000 | Korenic et al. |
| 6,213,200 | B1 | 4/2001 | Carter et al. |
| 6,531,056 | B2 | 3/2003 | Hammonds |
| 6,564,864 | B2 | 5/2003 | Carter et al. |
| 6,574,980 | B1 | 6/2003 | Morrison |
| 6,827,750 | B2 | 12/2004 | Drozd et al. |
| 6,835,218 | B1 | 12/2004 | Drozd et al. |
| 6,860,241 | B2 | 3/2005 | Martin et al. |
| 7,001,531 | B2 | 2/2006 | Chen et al. |
| 7,186,390 | B1 | 3/2007 | Hellbusch et al. |
| 7,581,558 | B2 | 9/2009 | Martin et al. |
| 7,591,279 | B2 | 9/2009 | Martin et al. |
| 2003/0122104 | A1 | 7/2003 | Blakemore et al. |
| 2003/0218150 | A1 | 11/2003 | Blakemore et al. |
| 2004/0091654 | A1 | 5/2004 | Kelly et al. |
| 2007/0000831 | A1 | 1/2007 | Kelly et al. |
| 2008/0296234 | A1 | 12/2008 | Kelly et al. |
| 2009/0283466 | A1 | 11/2009 | Martin et al. |
| 2009/0294345 | A1 | 12/2009 | Kelly et al. |
| 2009/0294379 | A1 | 12/2009 | Kelly et al. |
| 2009/0301968 | A1 | 12/2009 | Little et al. |
| 2009/0304868 | A1 | 12/2009 | Sundaram et al. |

OTHER PUBLICATIONS

PCT Notification of Transmittal of the International Search Report and the Written Opinion of the International Searching Authority, or Declaration dated Dec. 5, 2011. Forms PCT/ISA/220—PCT/ISA/210—PCT/ISA/237.

PCT Notification of Transmittal of the International Search Report and the Written Opinion of the International Searching Authority, or Declaration dated Dec. 5, 2011.

Notification of Transmittal of the International Search Report and the Written Opinion of the International Searching Authority, or the Declaration dated Dec. 16, 2011 in the Corresponding WIPO Application.

International Search Report and the the Written Opinion of the International Searching Authority, or the Declaration dated Jan. 6, 2012 for International Application No. PCT/US2011/045945.

HYBRID HEAT EXCHANGER APPARATUS AND METHOD OF OPERATING THE SAME

FIELD OF THE INVENTION

The present invention relates to a hybrid heat exchanger apparatus. More particularly, the present invention is directed to a hybrid heat exchanger apparatus that operates in a dry mode, a wet mode and a hybrid wet/dry mode in order to conserve water and, possibly, abate plume.

BACKGROUND OF THE INVENTION

Heat exchangers are well known in the art. By way of example, a conventional heat exchanger 2, sometimes referred to as a "closed-circuit cooler", is diagrammatically illustrated in FIGS. 1 and 2. The heat exchanger 2 includes a container 4, a heat exchanger device 6, a cooling water distribution system 8, an air flow mechanism such as a fan assembly 10 as illustrated and a controller 12. The container 4 has a top wall 4*a*, a bottom wall 4*b* and a plurality of side walls 4*c*. The plurality of side walls 4*c* are connected to each other and connected to the top wall 4*a* and the bottom wall 4*b* to form a generally shaped chamber 14. The chamber 14 has a water basin chamber portion 14*a*, an exit chamber portion 14*b* and a central chamber portion 14*c*. The water basin portion 14*a* is defined by the bottom wall 4*b* and lower portions of the side walls 4*c*. The water basin portion 14*a* contains evaporative cooling water CW. The exit chamber portion 14*b* is defined by the top wall 4*a* and upper portions of the side walls 4*c*. The central chamber portion 14*c* is defined between and among central portions of the connected side walls 4*c* and is positioned between the water basin chamber portion 14*a* and the exit chamber portion 14*b*. The top wall 4*a* is formed with an air outlet 16. The air outlet 16 is in fluid communication with the exit chamber portion 14*b*. Also, for this particular conventional heat exchanger 2, each one of the side walls 4*c* is formed with an air inlet 18 in communication with the central chamber portion 14*c*. A plurality of louver modules 20 are mounted to the side walls 4*c* in the respective the air inlets 18. The plurality of louver modules 20 are disposed adjacent to and above the water basin chamber portion 14*a* and are operative to permit ambient air, represented as Cold Air IN arrows, to enter into the central chamber portion 14*c*.

The heat exchanger device 6 is disposed in and extends across the central chamber portion 14*c* adjacent to and below the exit chamber portion 14*b*. The heat exchanger device 6 is operative to convey a hot fluid, represented as a Hot Fluid IN arrow, therethrough from a hot fluid source 23. It would be appreciated by a skilled artisan that the hot fluid could be water, a refrigerant, steam or such other gaseous or liquid fluid known in the art to be cooled by a heat exchanger device. The Hot Fluid IN exits the heat exchanger device 6 as cold fluid, represented as a Cold Fluid OUT arrow. Although a single heat exchanger device 6 can be used in any conventional heat exchanger 2, this heat exchanger device 6 includes a conventional first heat exchanger component 6*a* and a conventional second heat exchanger component 6*b* juxtaposed and in fluid communication with the first heat exchanger component 6*a*. Also, in the alternative, a conventional heat exchanger 2 might have a heat exchanger device 6 with a first heat exchanger component 6*b* and a second heat exchanger component 6*b* that are fluidically isolated from one another. A connector pipe 22 interconnects the first and second heat exchanger components 6*a* and 6*b* so that the first heat exchanger component 6*a* and the second heat exchanger component 6*b* are in serial fluid communication with one another. However, the first heat exchanger component 6*a* and the second heat exchanger component 6*b* can be connected in parallel fluid communication with one another or, alternatively, the first heat exchanger component 6*a* and the second heat exchanger component 6*b* can be disconnected from one another and are then considered in fluid isolation from one another.

As shown in FIGS. 1 and 2, both the first and second heat exchanger components 6*a* and 6*b* are tube structures. The first heat exchanger device 6*a* is a single, continuous tube 34 having a serpentine configuration with straight tube sections 34*a* having a plurality of fins 36 depicted by the vertical dashes. The tube structure of the second heat exchanger device 6*b* includes a plurality of straight bare tube sections 34*a*, i.e, tube sections without fins, in a straight-through configuration that interconnect an inlet header box 44*a* and a outlet header box 44*b*.

The cooling water distribution system 8 includes a water distribution manifold 24 that extends across the central chamber portion 14*c* and is disposed above and adjacent to the heat exchanger device 6. In a Pump ON state, a pump 26 is operative for pumping the evaporative cooling water CW from the water basin chamber portion 14*a* to and through the water distribution manifold 24. Thus, the evaporative cooling water CW is distributed onto the heat exchanger device 6 as represented by the water droplets 28 in FIG. 2. When the water droplets 28 rain downwardly onto the heat exchanger device 6 and into the water basin chamber portion 14*a*, the conventional heat exchanger 2 is in a WET mode as illustrated in FIG. 2. Correspondingly, with the pump is in a Pump OFF state, no water droplets 28 rain downwardly and, thus, the heat exchanger 2 is in a DRY mode as illustrated in FIG. 1.

As illustrated in FIGS. 1 and 2, the cooling water distribution system 8 includes a plurality of spray nozzles 30. The spray nozzles 30 are connected to and are in fluid communication with the water distribution manifold 24 so that the pump 26 pumps the evaporative cooling water CW to the water distribution manifold 24 and through the spray nozzles 30. However, one of ordinary skill in the art would appreciate that in lieu of spray nozzles 30, the cooling water distribution system 8 might include a weir arrangement, a drip arrangement or some other cooling water distribution arrangement known in the art.

Furthermore, in FIGS. 1 and 2, the heat exchanger 2 includes an eliminator structure 32 that extends across the chamber 14 and is disposed between the water distribution manifold 24 and the air outlet 16. The eliminator structure 32 is positioned in a manner such that the exit chamber portion 14*b* of the chamber 14 is disposed above the eliminator structure 32 and the central chamber portion 14*c* of the chamber 14 is disposed below the eliminator structure 32.

In a Fan ON state shown in both FIGS. 1 and 2, the fan assembly 10 is operative for causing the ambient air represented by the Cold Air IN arrows to flow through the heat exchanger 2 from the air inlet 18, across the heat exchanger device 6 and the water distribution manifold 24 and through the air outlet 16. Shown in FIG. 1, in the DRY mode, hot dry air represented by the Hot Dry Air Out arrow flows out of the air outlet 16. Shown in FIG. 2, in the WET mode, hot humid air represented by Hot Humid Air Out arrow flows out of the air outlet 16. As known in the art, the fan assembly 10 shown in FIGS. 1 and 2 is an induced draft system to induce the ambient air to flow through the container 4 as illustrated.

The controller 12 is operative to selectively energize or de-energize the cooling water distribution system 8 and the fan assembly 10 by automatically or manually switching the cooling water distribution system 8 and the fan assembly 10 between their respective ON states and an OFF states in order to cause the heat exchanger 2 to operate in either the WET mode or the DRY mode. The controller 12 might be an electro-mechanical device, a software-operated electronic device or even a human operator. In FIG. 1, for the heat exchanger 2 to be in the DRY mode, the controller 12 switches the fan assembly 10 to the Fan ON state and switches the pump 26 to the Pump OFF state. In FIG. 2, for the heat exchanger 2 to be in the WET mode, the controller 12 switches the fan assembly 10 to the Fan ON state and switches the pump 26 to the Pump ON state. More particularly, in the WET mode, both the fan assembly 10 and the cooling water distribution system 8 are energized resulting in the ambient air (Cold Air IN arrows) flowing through the heat exchanger device 6 and the evaporative cooling water CW being distributed onto and across the heat exchanger device 6 to generate the hot humid air (Hot Humid Air OUT arrow in FIG. 2) that exits through the air outlet 16. And, in the DRY mode, only the fan assembly 10 is energized while the cooling water distribution system 8 is de-energized resulting in the ambient air (Cold Air IN arrows) flowing across the heat exchanger device 6, without the evaporative cooling water CW being distributed onto and across the heat exchanger device 6, to generate hot dry air (Hot Dry Air OUT arrow in FIG. 1) that subsequently exits through the air outlet 16.

Typically, during the summer months, the heat exchanger 2 operates in the WET mode and, during the winter months, the heat exchanger 2 operates in the DRY mode. Sometimes, during the spring and fall months, the ambient conditions cause the hot humid air that exits the heat exchanger to condense, thereby forming a visible plume P of water condensate. The general public sometimes mistakenly perceive this visible plume P of water condensate as air-polluting smoke. Also, some people, who know that this plume P is merely water condensate, believe that the minute water droplets that constitute the visible plume P might contain disease-causing bacteria. As a result, a heat exchanger that spews a visible plume P of water condensate is undesirable.

There are two limitations on heat exchangers that the present invention addresses. First, particularly in cold climates, closed circuit coolers can emit plume when the warm, humid air being discharged from the unit meets the cold, dry air in the ambient environment. The general public sometimes mistakenly perceives this visible plume of water condensate as air-polluting smoke. Second, water is considered to be a scarce and valuable resource in certain regions. In certain aspects of the present invention, there is an increased capacity to perform the cooling functions in a DRY mode, where little or no water is needed to achieve the cooling function.

A skilled artisan would appreciate that the diagrammatical views provided herein are representative drawing figures that represent either a single heat exchanger as described herein or a bank of heat exchangers.

It would be beneficial to provide a heat exchanger that conserves water. It would also be beneficial to provide a heat exchanger apparatus that might also inhibit the formation of a plume of water condensate. The present invention provides these benefits.

OBJECTS AND SUMMARY OF THE INVENTION

It is an object of the invention to provide a hybrid heat exchanger apparatus that might inhibit the formation of a plume of water condensate when ambient conditions are optimal for formation of the same.

It is another object of the invention to provide a hybrid heat exchanger apparatus that conserves water by enhanced dry cooling capabilities.

Accordingly, a hybrid heat exchanger apparatus of the present invention is hereinafter described. The hybrid heat exchanger apparatus includes a heat exchanger device with a hot fluid flowing through it, a cooling water distribution system and an air flow mechanism such as a fan assembly for causing ambient air to flow across the heat exchanger device. The cooling water distribution system distributes evaporative cooling water onto the heat exchanger device in a manner to wet only a portion of the heat exchanger device while allowing a remaining dry portion of the heat exchanger device. The remaining dry portion of the heat exchanger enables cooling in a non-evaporative manner. The air flow mechanism causes ambient air to flow across the heat exchanger device to generate hot humid air from the ambient air flowing across the wet portion of the heat exchanger device and hot dry air from the ambient air flowing across the remaining dry portion of the heat exchanger device. One aspect of the present invention mixes the hot humid air and the hot dry air together to form a hot air mixture thereof to abate plume if the appropriate ambient atmospheric conditions are present. Another aspect of the present invention isolates the hot humid air and the hot dry air from one another and, therefore, does not necessarily abate plume.

A method of the present invention inhibits formation of a water-based condensate from a heat exchanger apparatus having a cooling water distribution system and a heat exchanger device with a hot fluid flowing therethrough. The method includes the steps of:

distributing evaporative cooling water from the cooling water distribution system onto the heat exchanger device in a manner to wet a portion of the heat exchanger device while allowing a remaining portion of the heat exchanger device to be dry;

causing ambient air to flow across the heat exchanger device to generate hot humid air from the ambient air flowing across the wet portion of the heat exchanger device and hot dry air from the ambient air flowing across the remaining dry portion of the heat exchanger device; and mixing the hot humid air and the hot dry air together to form a hot air mixture thereof.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Hereinafter, exemplary embodiments of the present invention will be described with reference to the attached drawing figures. The structural components common to those of the prior art and the structural components common to respective embodiments of the present invention will be represented by the same symbols and repeated description thereof will be omitted. Furthermore, terms such as "cold", "hot", "humid", "dry", "cooling" and the like shall be construed as relative terms only as would be appreciated by a skilled artisan and shall not be construed in any limiting manner whatsover.

Figure 3:
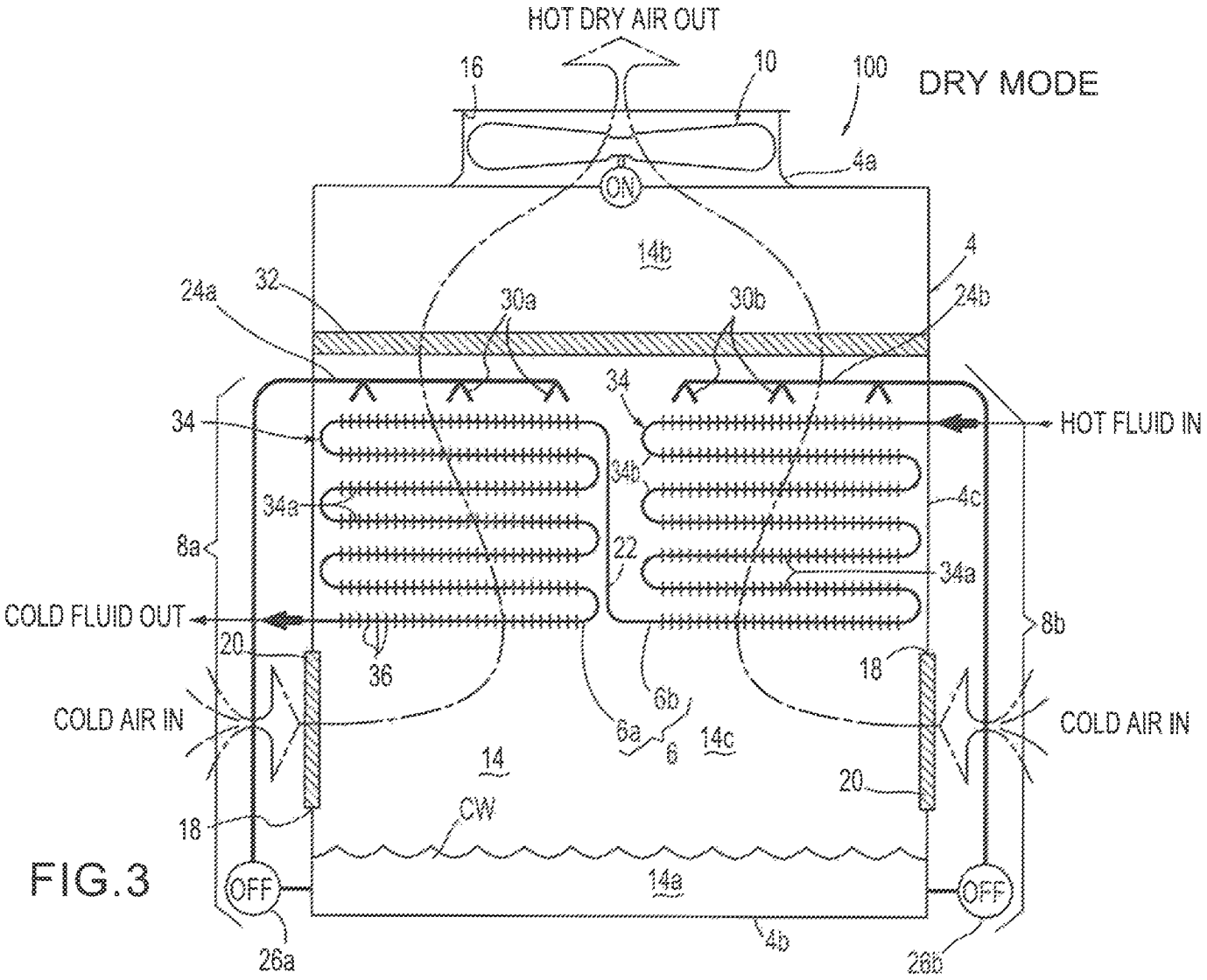
FIG. 3 is a schematic diagram of a first exemplary embodiment of a hybrid heat exchanger apparatus of the present invention operating in the dry mode.
Figure 4:
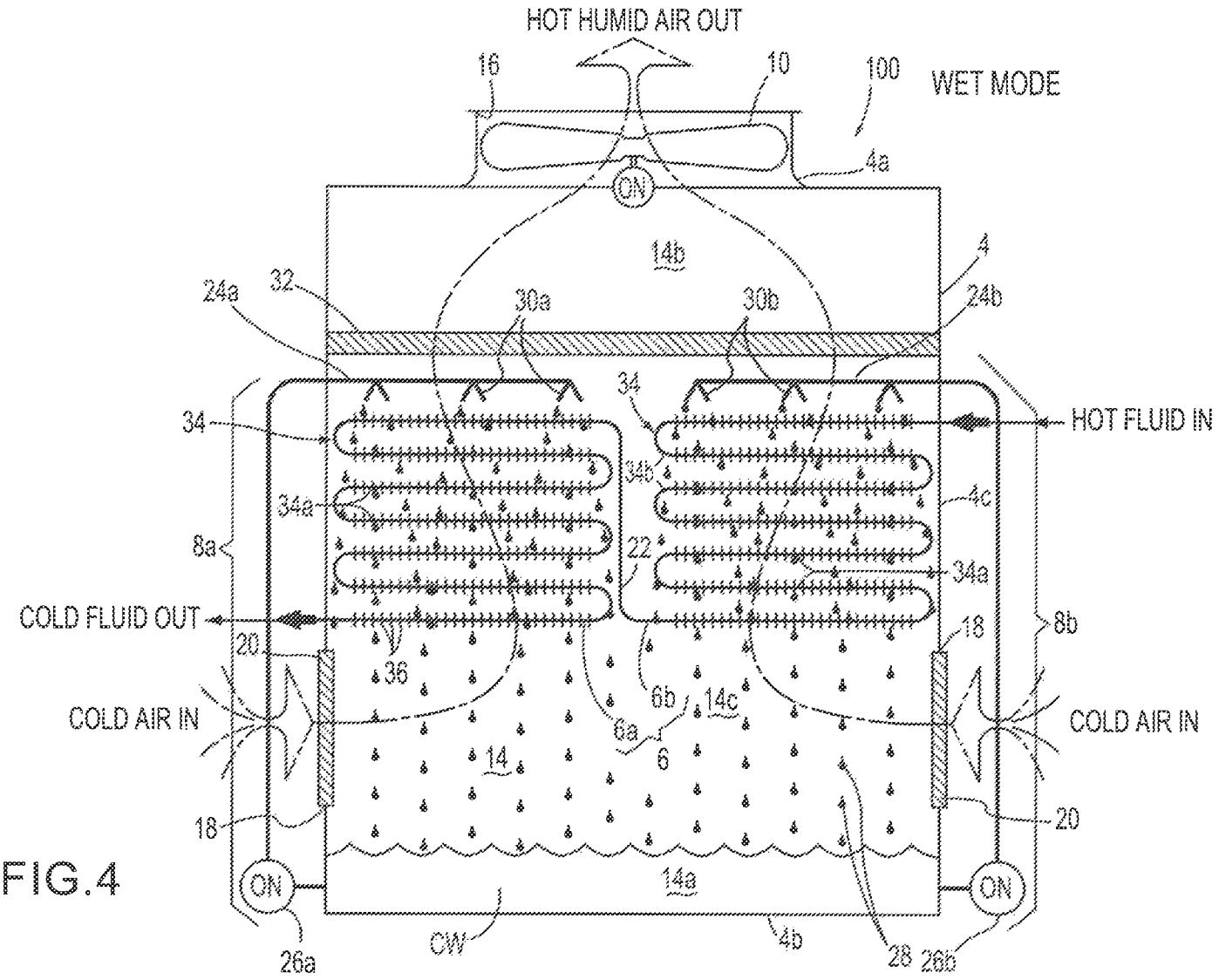
FIG. 4 is a schematic diagram of the first exemplary embodiment of the hybrid heat exchanger apparatus of the present invention operating in the wet mode.
Figure 5:
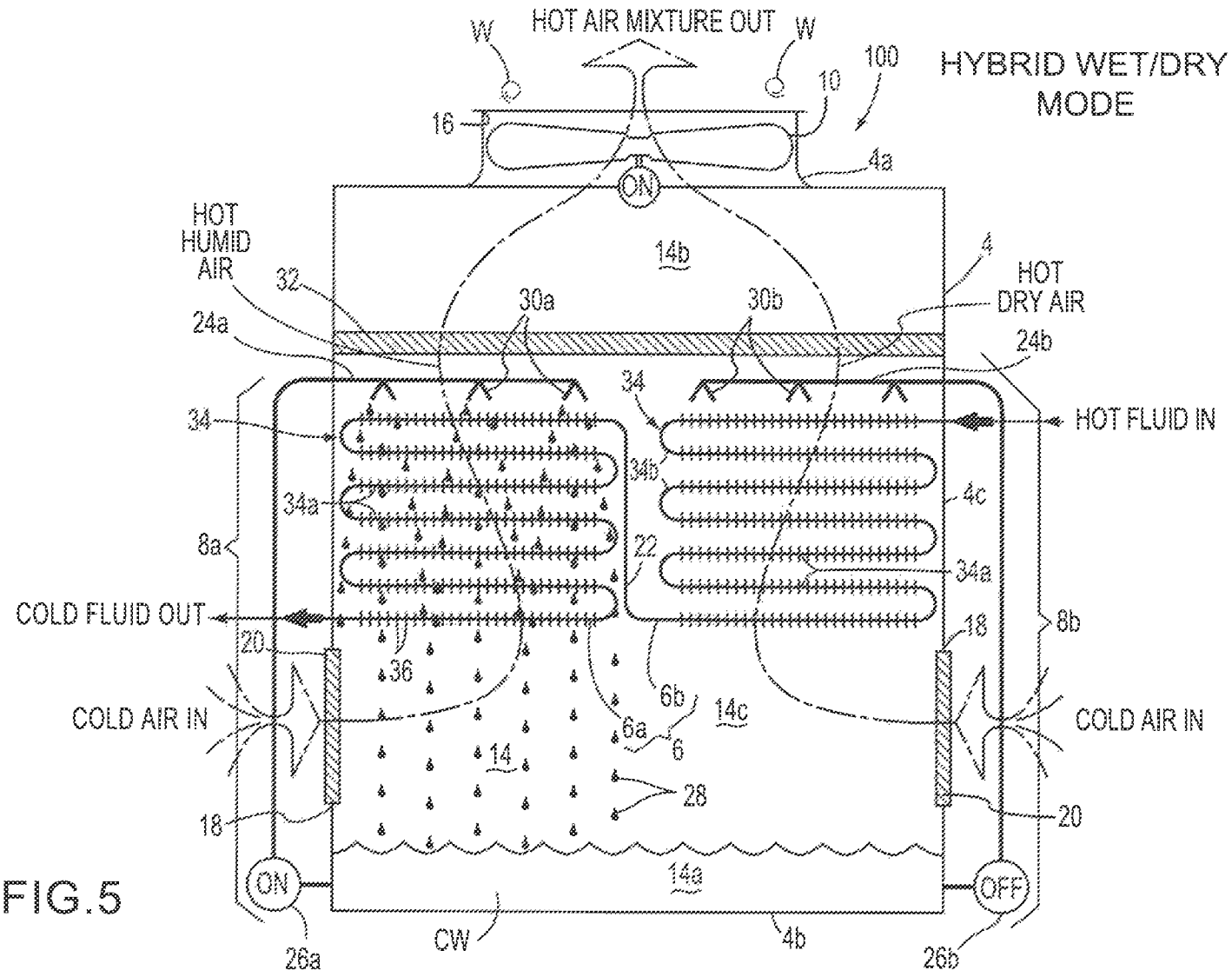
FIG. 5 is a schematic diagram of the first exemplary embodiment of the hybrid heat exchanger apparatus of the present invention operating in a hybrid wet/dry mode.

A first exemplary embodiment of a hybrid heat exchanger apparatus 100 of the present invention is hereinafter described with reference to FIGS. 3-5. As shown in FIGS. 3-5, the hybrid heat exchanger apparatus 100 includes a first cooling water distribution system 8*a* and a second cooling water distribution system 8*b*. The first cooling water distribution system 8*a* has a first water distribution manifold 24*a* that extends partially across the central chamber portion 14*c* and is disposed above and adjacent to the first heat exchanger component 6*a*. The first cooling water distribution system 8*a* also has a first pump 26*a* that is operative for pumping the evaporative cooling water CW from the water basin chamber portion 14*a* to and through the first water distribution manifold 24*a*. As a result, the spray nozzles 30*a* spray the evaporative cooling water CW thereby the evaporative cooling water CW is distributed onto the first heat exchanger component 6*a*. Correspondingly, the second cooling water distribution system 8*b* has a second water distribution manifold 24*b* that extends partially across the central chamber portion 14*c* and is disposed above and adjacent to the second heat exchanger component 6*b*. The second cooling water distribution system 8*b* also has a second pump 26*b* that is operative for pumping the evaporative cooling water CW from the water basin chamber portion 14*a* to and through the water distribution manifold 24*a*. As a result, the evaporative cooling water CW is sprayed from the spray nozzles 30*b* and thus the evaporative cooling water CW is distributed onto the second heat exchanger component 6*b*. Note that the first and second cooling water distribution systems 8*a* and 8*b* operate independently of one another and, other than pumping evaporative cooling water CW from the water basin chamber portion 14*a*, are otherwise considered in fluid isolation from one another. Also, the first pump 26*a* and the first water distribution manifold 24*a* are in selective fluid communication with one another and the second pump 26*b* and the second water distribution manifold 24*b* are in selective fluid communication with one another.

Figure 1:
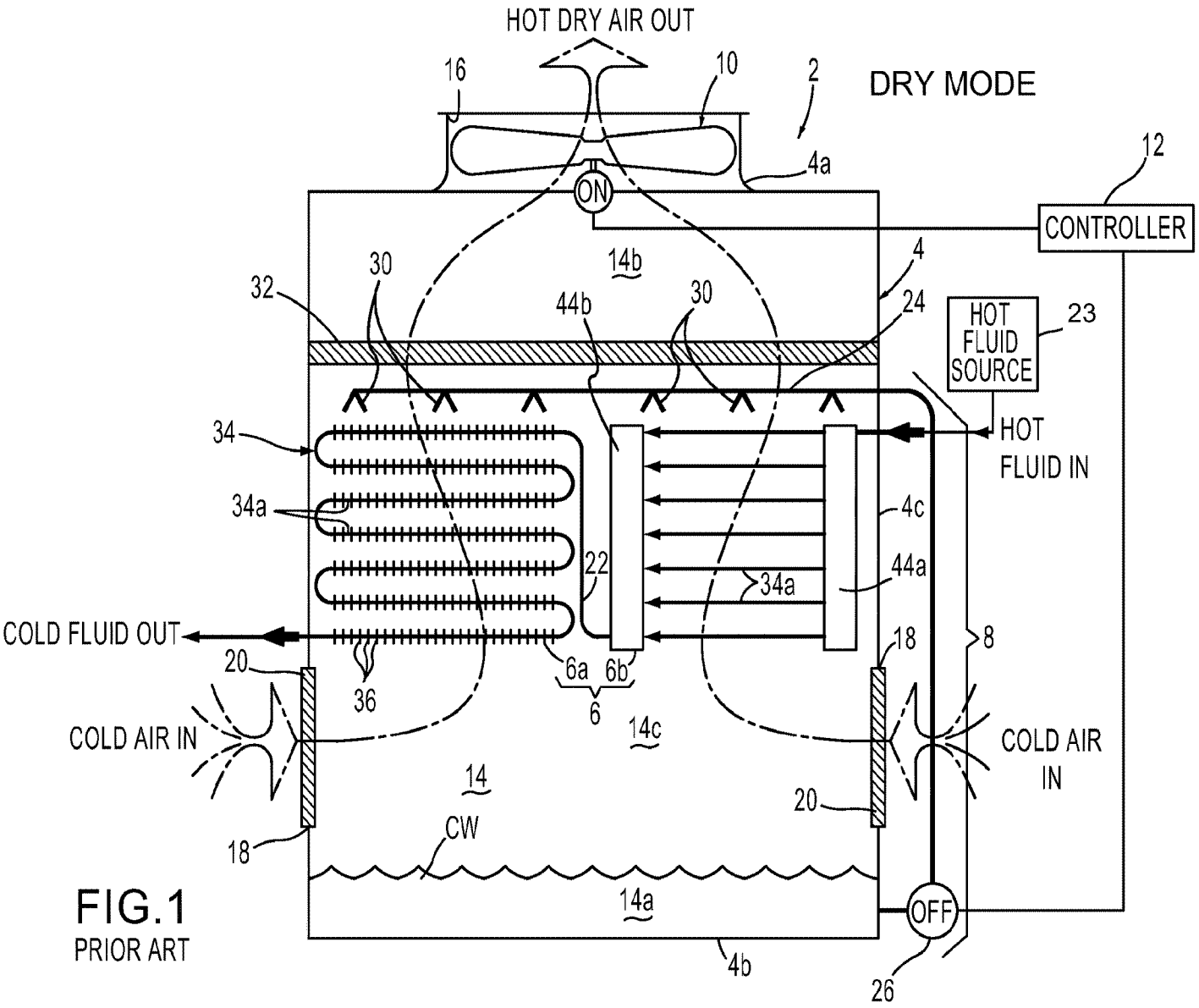
FIG.1 PRIOR ART
FIG. 1 is a schematic diagram of a conventional heat exchanger operating in a dry mode.
Figure 2:
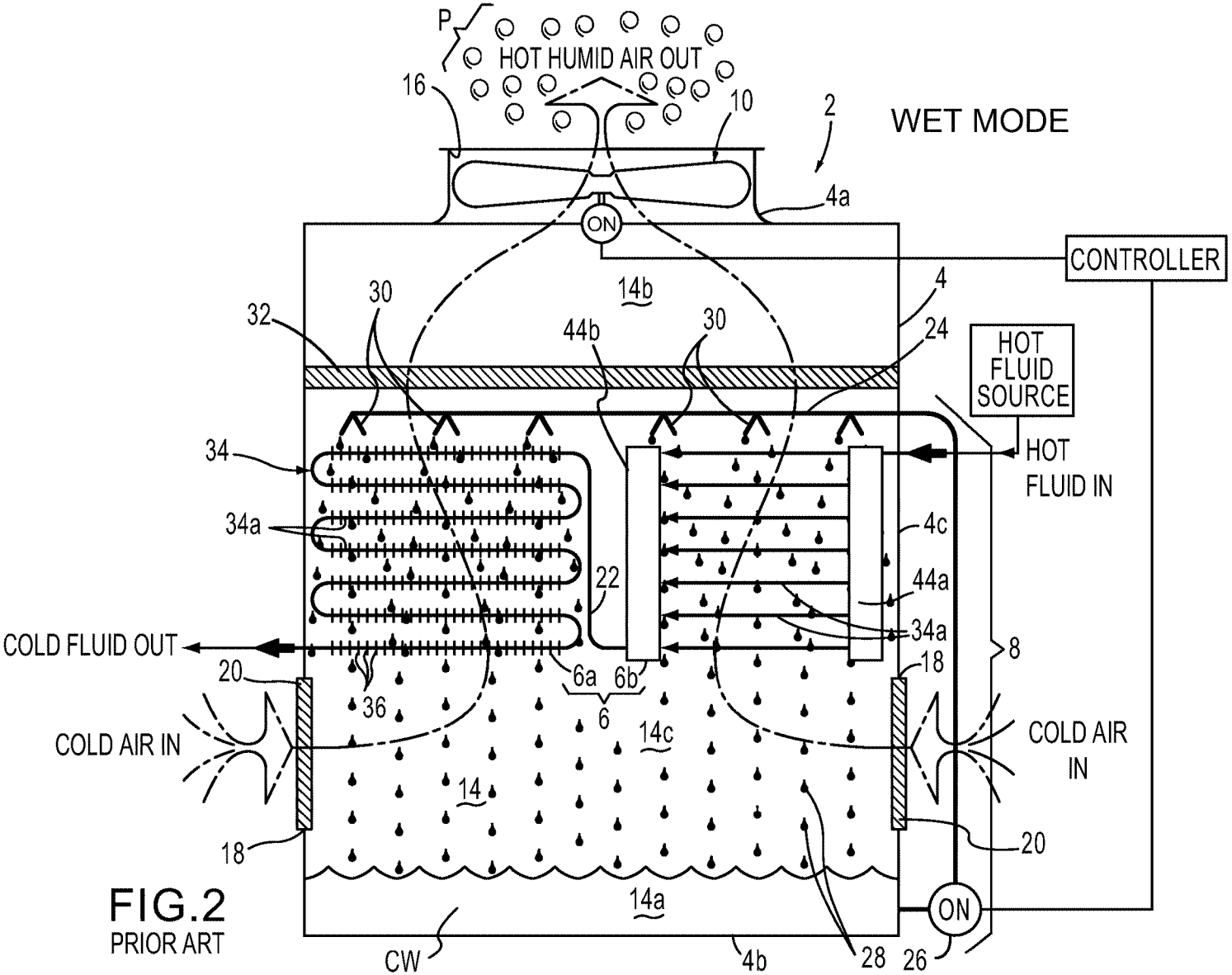
FIG.2 PRIOR ART
FIG. 2 is a schematic diagram of a conventional heat exchanger operating in a wet mode.

A controller (not shown but illustrated for example purposes in FIGS. 1 and 2) is operative for causing the hybrid heat exchanger apparatus 100 to operate in either a DRY mode as illustrated in FIG. 3, a WET mode as illustrated in FIG. 4 and a HYBRID WET/DRY mode as illustrated in FIG. 5. For sake of clarity of the drawing figures, the controller was intentionally not illustrated because one of ordinary skill in the art would appreciate that a controller can automatically change the ON and OFF states of the pumps 26*a* and 26*b* and the fan assembly 10. Alternatively, one of ordinary skill in the art would appreciate that the controller might be a human operator who can manually change the ON and OFF states of the pumps 26*a* and 26*b* and the fan assembly 10. As a result, rather than illustrating a controller, the ON and OFF states of the pumps 26*a* and 26*b* and the fan assembly 10 are illustrated.

In the DRY mode illustrated in FIG. 3, only the fan assembly 10 is energized in the ON state while both of the cooling water distribution systems 8*a* and 8*b* are de-energized, i.e., in the OFF states. As a result, the ambient air represented as the Cold Air IN arrows flows across the first heat exchanger component 6*a* and the second heat exchanger component 6*b* device without the evaporative cooling water CW being distributed onto and across the first and second heat exchanger components 6*a* and 6*b*. In this manner, hot dry air represented as the Hot Dry Air OUT arrow is generated that subsequently exits through the air outlet 16.

In the WET mode illustrated in FIG. 4, the fan assembly 10 and both of the cooling water distribution systems 8*a* and 8*b* are energized in their respective ON states. As a result, the ambient air represented as the Cold Air IN arrows flows across respective ones of the first heat exchanger component 6*a* and the second heat exchanger component 6*b* and the evaporative cooling water CW is distributed onto and across the first and second heat exchanger components 6*a* and 6*b* to generate hot humid air as represented as the Hot Humid Air OUT arrow that subsequently exits through the air outlet 16.

In the HYBRID WET/DRY mode, the fan assembly 10 and the cooling water distribution system 8*a* are energized in their ON states while the cooling water distribution system 8*b* is de-energized, i.e., in its OFF state. As a result, the cooling water distribution system 8*a* distributes evaporative cooling water CW across and onto the first heat exchanger component 6*a* in a manner to wet the first heat exchanger component 6*a* while the second heat exchanger component 6*b* is dry. Simultaneously therewith, the fan assembly 10 causes the ambient air represented as the Cold Air IN arrows to flow across the first heat exchanger component 6*a* to generate HOT HUMID AIR from the ambient air represented as the Cold Air IN arrows flowing across the wet first heat exchanger component 6*a* and HOT DRY AIR from the ambient air represented as the Cold Air IN arrows flowing across the dry second heat exchanger component 6*b*. Thereafter, the HOT HUMID AIR and the HOT DRY AIR mix together to form a HOT AIR MIXTURE that subsequently exits through the air outlet 16 as represented by the HOT AIR MIXTURE OUT arrow. The HOT HUMID AIR and the HOT DRY AIR also flow through the eliminator structure 32, into the exit chamber portion 14*b* and through the fan assembly 10 before exiting the air outlet 16.

One of ordinary skill in the art would appreciate that mixing of the HOT HUMID AIR and the HOT DRY AIR to form the HOT AIR MIXTURE is achieved as a result of the torrent of air flowing through the container 4 as well as through the fan assembly 10. Additional mixing, if desired, can also be achieved as discussed hereinbelow.

By way of example only and not by way of limitation, each one of the first and second heat exchanger components 6*a* and 6*b* is a tubular structure which is represented in the drawing figures as a single, continuous tube 34. However, one of ordinary skill in the art would appreciate that, in practice, the tubular structure is actually fabricated from a plurality of tubes aligned in rows. The representative single, continuous tube 34 is formed in a serpentine tube configuration as shown in FIGS. 3-5 that has straight tube sections 34*a* and return bend sections 34*b*. Although not by way of limitation but by example only, straight tube section 34*a* has a plurality of fins 36 connected thereto to form a finned tube structure.

Figure 6:
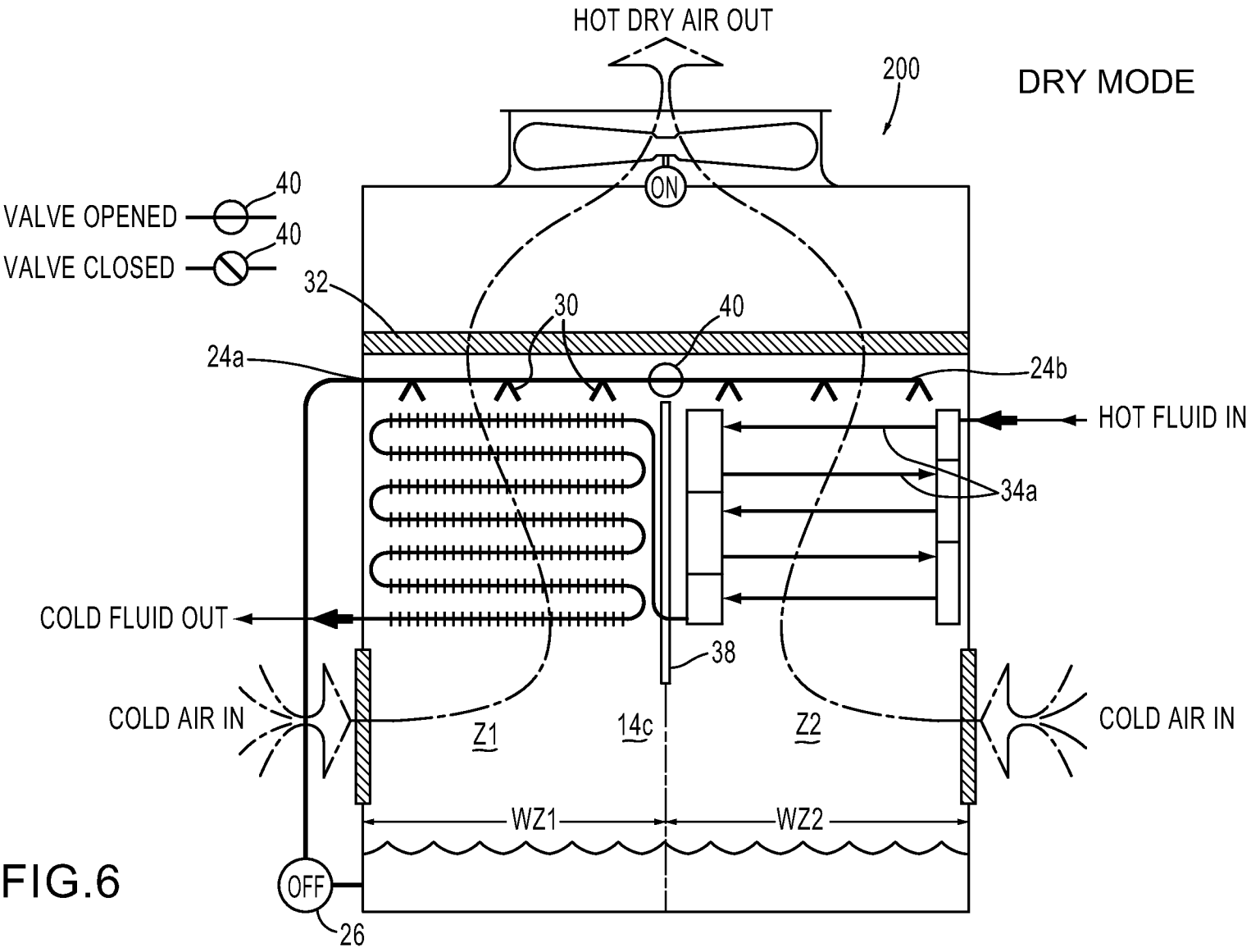
FIG. 6 is a schematic diagram of a second exemplary embodiment of a hybrid heat exchanger apparatus of the present invention operating in the dry mode.
Figure 7:
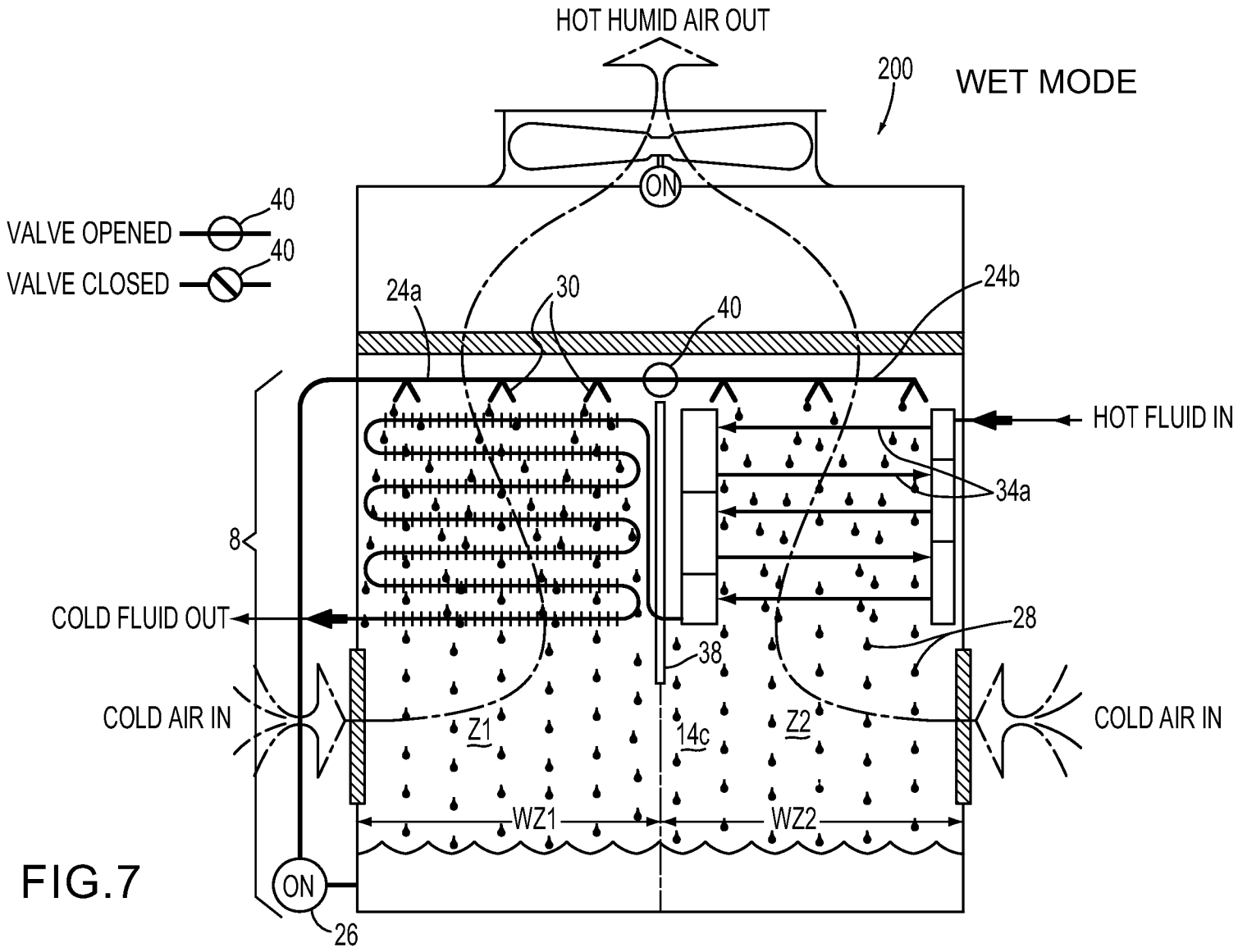
FIG. 7 is a schematic diagram of the second exemplary embodiment of the hybrid heat exchanger apparatus of the present invention operating in the wet mode.
Figure 8:
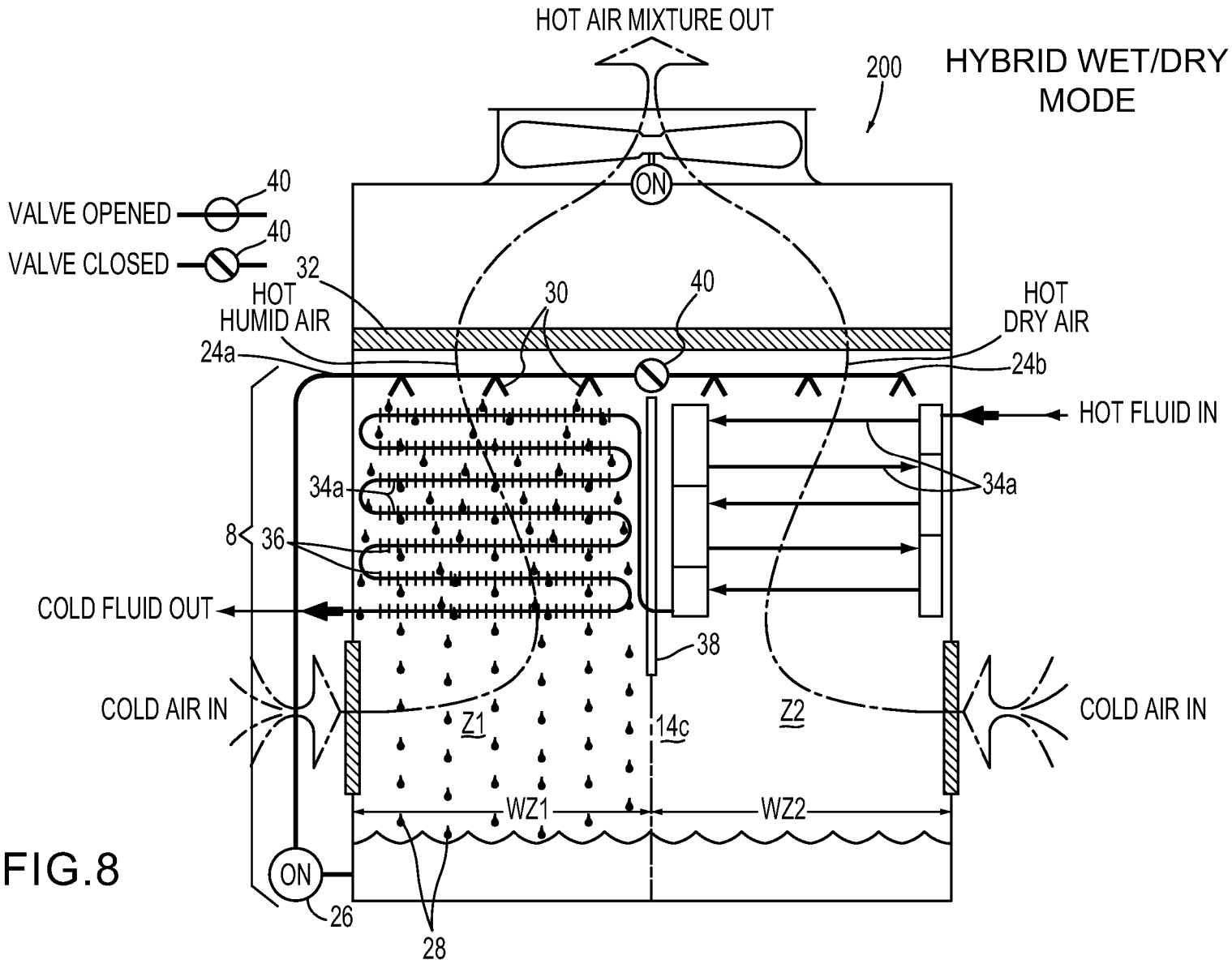
FIG. 8 is a schematic diagram of the second exemplary embodiment of the hybrid heat exchanger apparatus of the present invention operating in the hybrid wet/dry mode.

A second exemplary embodiment of a hybrid heat exchanger apparatus 200 of the present invention is shown in FIGS. 6-8. The hybrid heat exchanger apparatus 200 includes a partition 38. The partition 38 vertically divides the heat exchanger device 6 so that, when the hybrid heat exchanger apparatus 200 is in the HYBRID WET/DRY mode as shown in FIG. 8, the wet first heat exchanger component 6*a* and the dry heat exchanger component 6*b* are delineated. Specifically, the partition 38 is disposed between the first water distribution manifold section 24*a* and the second water distribution manifold section 24*b* and between the first heat exchanger component 6*a* and the second heat exchanger component 6*b*. As depicted in FIG. 8, when the hybrid heat exchanger apparatus 200 is in the HYBRID WET/DRY mode, a first operating zone Z1 in the central chamber portion 14*c* and a second operating zone of the central chamber portion 14*c* are delineated. The first operating zone Z1 of the central chamber portion 14*c* has a horizontal first operating zone width WZ1 and the second operating zone Z2 of the central chamber portion 14*c* has a horizontal second operating zone width WZ2. By way of example only for the second exemplary embodiment of the hybrid heat exchanger apparatus 200, the horizontal first operating zone width ZW1 and the horizontal second operating zone width ZW2 are at least substantially equal to each other.

For the second exemplarly embodiment of the hybrid heat exchanger apparatus 200, the first heat exchanger component 6*a* is a conventional finned tube structure as discussed above and the second heat exchanger component 6*b* is has a tube structure formed with a plurality of straight tube sections 34*a* in a conventional header-box configuration. Each one of the straight tube sections 34*a* are bare tubes in that there are no fins connected to the straight tube sections 34*a*.

With reference to FIGS. 6-8, the cooling water distribution system 8 includes a valve 40 that is interposed in the water distribution manifold 24 that divides the water distribution manifold 24 into the first water distribution manifold section 24*a* and the second water distribution manifold section 24*b* being in selective fluid communication with the first water distribution manifold section 24*a*. Again, a controller is not shown in FIGS. 6-8 to maintain clarity of the drawing figures. However, one of ordinary skill in the art would appreciate that the controller is operative to move the valve 40 to and between a Valve OPENED state and a Valve CLOSED state as reflected by the legend on FIGS. 6-8. With the valve 40 disposed between the first water distribution manifold section 24*a* and the second water distribution manifold section 24*b*, when the valve 40 is in the Valve OPENED state as shown in FIGS. 6 and 7, the first and second water distribution manifold sections 24*a* and 24*b* respectively are in fluid communication with one another. In FIG. 6 with the hybrid heat exchanger apparatus 200 in the DRY mode, the valve 40 might also be in the Valve CLOSED state because the pump 26 is in the Pump OFF state. As a result, both the first and second operating zones Z1 and Z2 respectively are dry. In FIG. 7 with the hybrid heat exchanger apparatus 200 in the WET mode, the valve 40 is in the Valve OPENED state and the pump 26 is in the Pump ON state. As a result, both the first and second operating zones Z1 and Z2 respectively are wet. In FIG. 8 with the hybrid heat exchanger apparatus 200 in a HYBRID WET/DRY mode, the valve 40 is in the Valve CLOSED state and the pump 26 is in the Pump ON state. When the valve 40 is in the Valve CLOSED state, the first water distribution manifold section 24*a* and the second water distribution manifold section 24*b* are in fluid isolation from one another. As a result, the first operating zone Z1 is wet while the second operating zone Z2 is dry so that the hybrid heat exchanger apparatus 200 can operate in the HYBRID WET/DRY mode.

Figure 9:
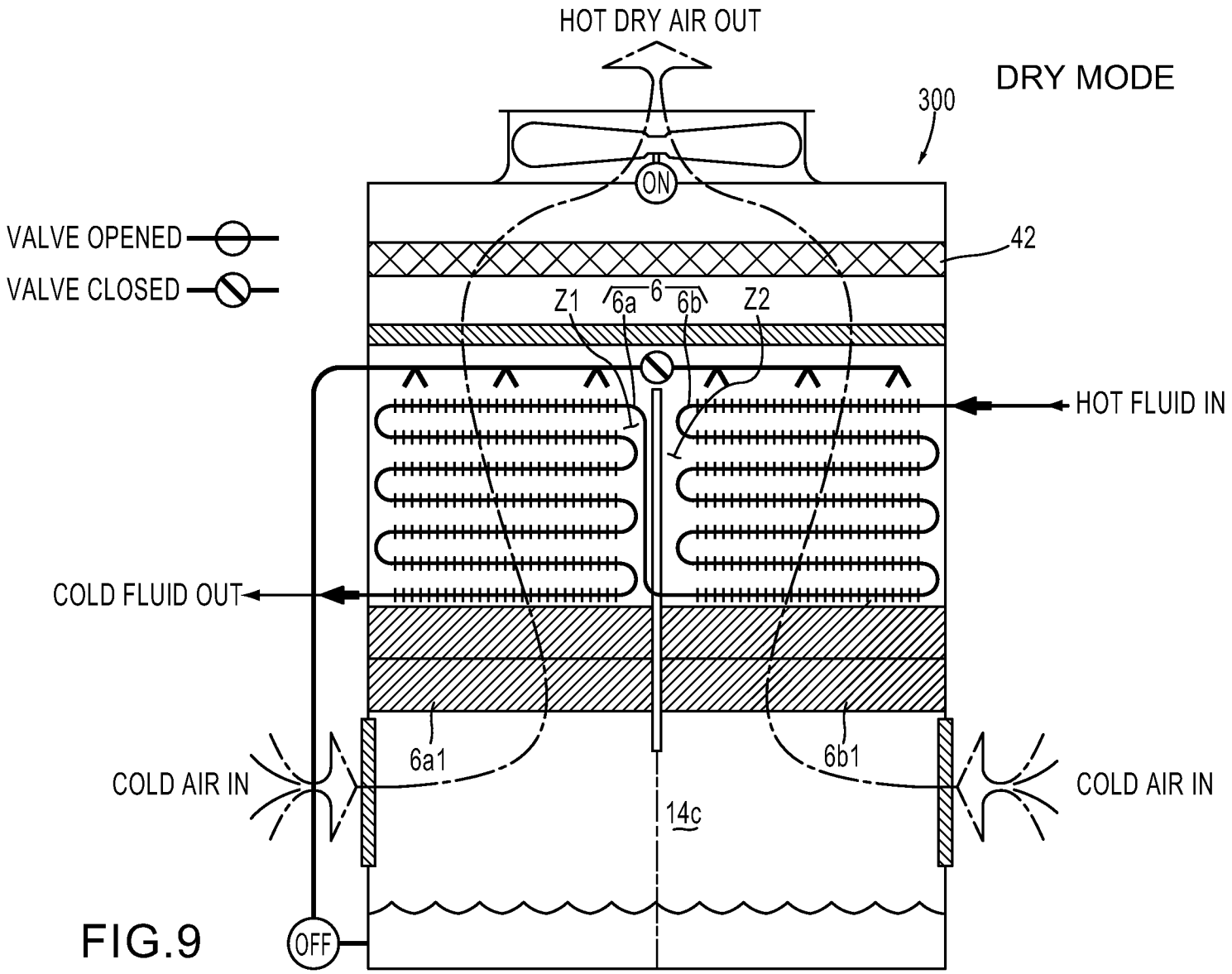
FIG. 9 is a schematic diagram of a third exemplary embodiment of a hybrid heat exchanger apparatus of the present invention operating in the dry mode.
Figure 10:
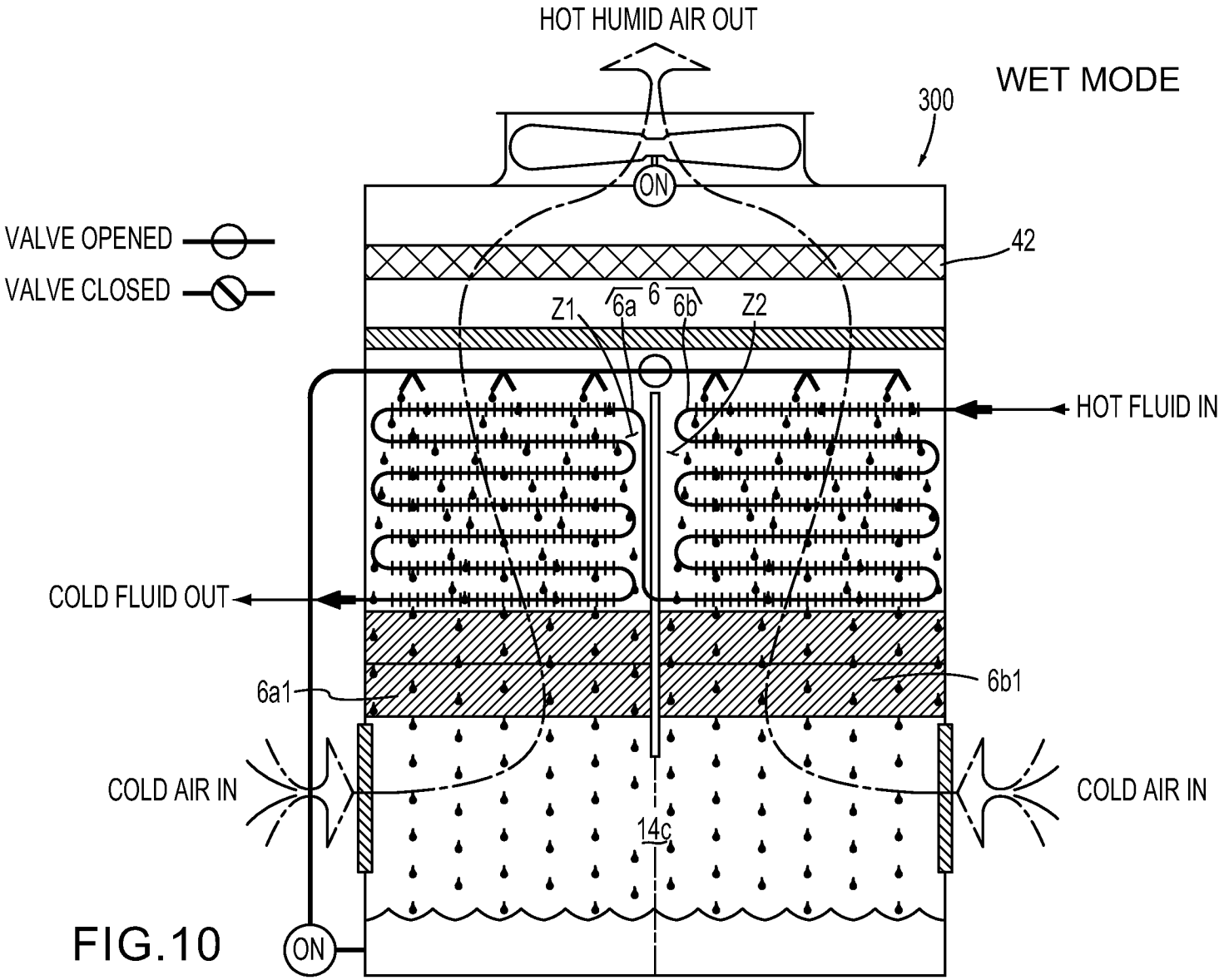
FIG. 10 is a schematic diagram of the third exemplary embodiment of the hybrid heat exchanger apparatus of the present invention operating in the wet mode.
Figure 11:
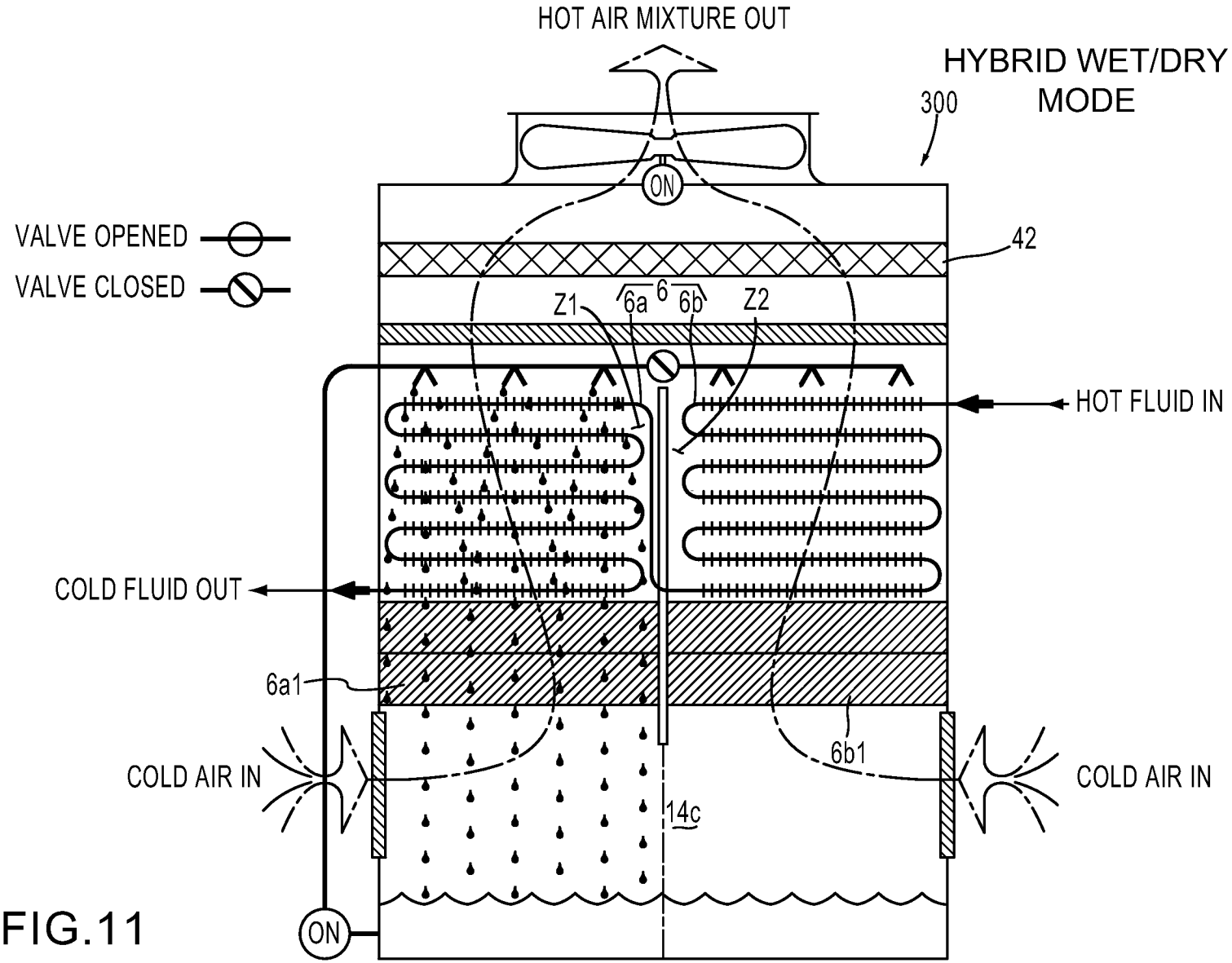
FIG. 11 is a schematic diagram of the third exemplary embodiment of the hybrid heat exchanger apparatus of the present invention operating in the hybrid wet/dry mode.
Figure 12:
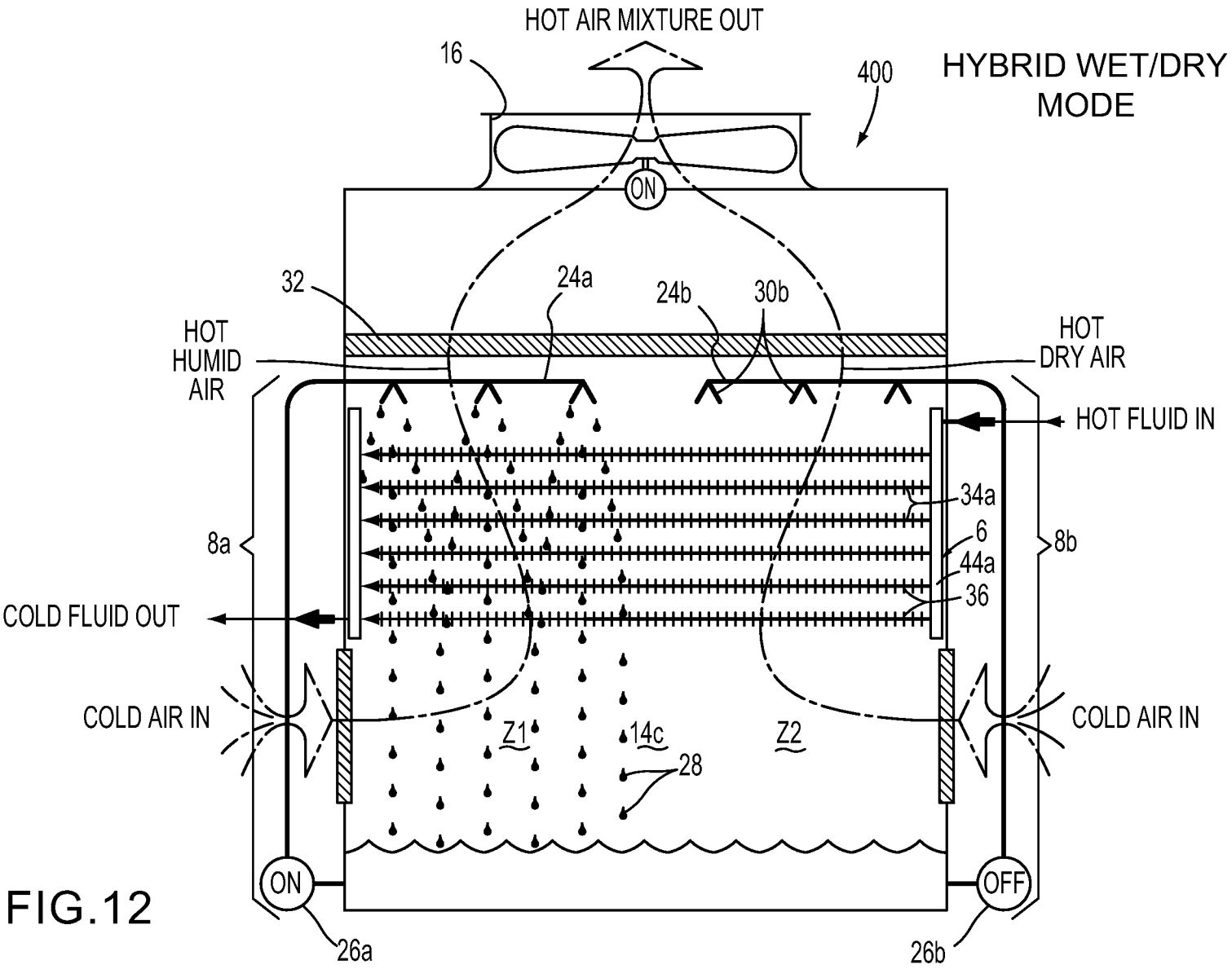
FIG. 12 is a schematic diagram of a fourth exemplary embodiment of a hybrid heat exchanger apparatus of the present invention operating in the hybrid wet/dry mode.

A third exemplary embodiment of a hybrid heat exchanger apparatus 300 of the present invention is shown in FIGS. 9-11 that operates in the DRY mode (FIG. 9), the WET mode (FIG. 10) and the HYBRID WET/DRY mode (FIG. 11) in a manner similar to the hybrid heat exchanger apparatus 200 discussed above. By way of example only and not by way of limitation, the hybrid heat exchanger apparatus 300 includes a mixing baffle structure 42. The mixing baffle structure 42 extends across the chamber 14 in the exit chamber portion 14*b* thereof. As best shown in FIG. 12, the mixing baffle structure 42 is operative to assist in mixing the HOT HUMID AIR and the HOT DRY AIR as the HOT AIR MIXTURE before it exits the air outlet 16.

For the hybrid heat exchanger apparatus 300 illustrated in FIGS. 9-11, the heat exchanger device 6 includes the first heat exchanger component 6*a* and the second heat exchanger component 6*b*, which, as discussed above, are the finned tube structures. Also, heat exchangers sometimes use fill media as a direct means of heat transfer, whether alone or in conjunction with coils such as the invention described in U.S. Pat. No. 6,598,862. As depicted in FIGS. 9-11 of the present invention, the heat exchanger device 6 includes a conventional first fill material structure 6*a*1 and a conventional second fill material structure 6*b*1, both of which being fabricated from the fill media. The first heat exchange component 6*a* and the first fill material structure 6*a*1 are vertically arranged with one on top of the other and the second heat exchanger component 6*b* and the second fill material structure 6*b*1 are vertically arranged with one on top of the other. More specifically, by way of example only and not by way of limitation, the first heat exchange component 6*a* is vertically positioned above the first fill material structure 6*a*1 and the second heat exchanger component 6*b* is vertically positioned above the second fill material structure 6*b*1.

The following exemplary embodiments of the hybrid heat exchanger apparatus of the present invention are illustrated only in the HYBRID WET/DRY mode. A skilled artisan would comprehend that the controller controls the Fan ON state of the fan assembly 10 and Pump ON and Pump OFF states of the pumps 26*a* and 26*b* to achieve the DRY mode, the WET mode and the HYBRID WET/DRY mode of the hybrid heat exchanger apparatus of the present invention as discussed hereinabove.

A fourth exemplary embodiment of a hybrid heat exchanger apparatus 400 of the present invention in the HYBRID WET/DRY mode is shown in FIG. 12. The heat exchanger device 6 is conventional and is a single unit, i.e., the heat exchanger device 6 does not include a first heat exchanger component and a second heat exchanger component. The heat exchanger device 6 includes a plurality of straight tube sections 34*a* with each straight tube section having fins 36. As the HOT FLUID flows through this single-unit heat exchanger device 6, the HOT FLUID as the Hot Fluid IN flows into an inlet header box 44*a*, then through the plurality of the finned, straight tube sections 34*a* and thereafter into an outlet header box 44*b* as the Cold Fluid OUT. Thus, this tube structure is a straight-through configuration.

Note also that even though the hybrid heat exchanger apparatus 400 lacks a partition, the first operating zone Z1 and the second operating zone Z2 exist. In the HYBRID WET/DRY mode of the hybrid heat exchanger apparatus 400, only the fan assembly 10 and the first cooling water distribution system 6*a* are energized such that only the first cooling water distribution system 26*a* distributes evaporative cooling water CW across and onto the single-unit heat exchanger device 6 in a manner to wet a portion of the heat exchanger device 6 in the first operating zone Z1 while a remaining portion of the heat exchanger device 6 is dry in the second operating zone Z2. Simultaneously therewith, the fan assembly 10 in the Fan ON state causes the ambient air illustrated as the Cold Air IN arrows to flow across the heat exchanger device 6 to generate the HOT HUMID AIR from the ambient air (represented as the Cold Air IN arrows) flowing across the wet portion of the heat exchanger device 6 in the first operating zone Z1 and the HOT DRY AIR from the ambient air (represented as the Cold Air IN arrows) flowing across the remaining dry portion of the heat exchanger device 6 in the second operating zone Z2 so that the HOT HUMID AIR and the HOT DRY AIR thereafter mix together to form the HOT AIR MIXTURE that subsequently exits the hybrid heat exchanger apparatus 400 through the air outlet 16.

Figure 13:
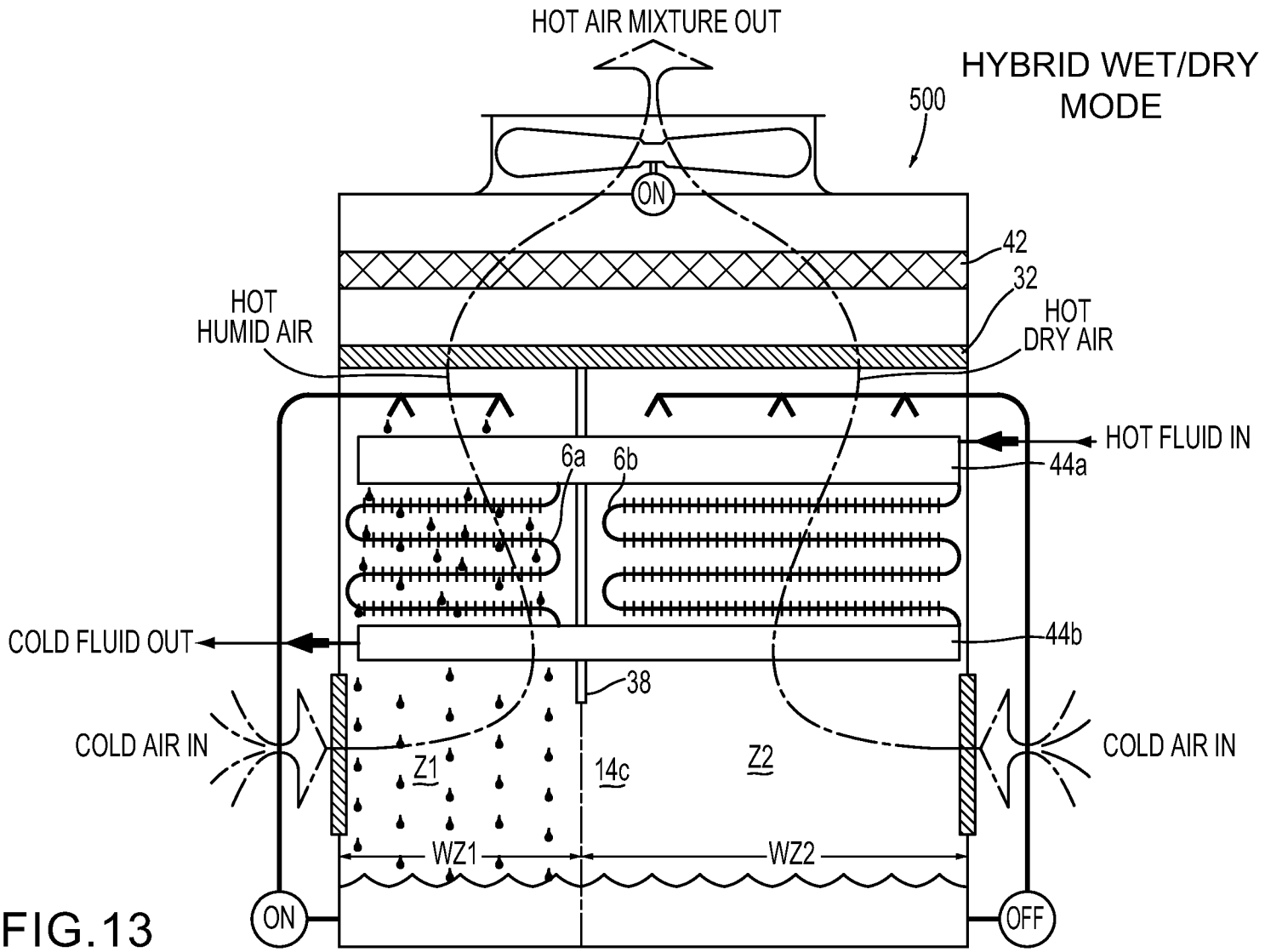
FIG. 13 is a schematic diagram of a fifth third exemplary embodiment of a hybrid heat exchanger apparatus of the present invention operating in the hybrid wet/dry mode.

A fifth exemplary embodiment of a hybrid heat exchanger apparatus 500 of the present invention in the HYBRID WET/DRY mode is shown in FIG. 13. The heat exchanger device 6 is conventional and includes the first heat exchanger component 6*a* and the second heat exchanger component 6*b* as a finned, serpentine tube structures. In this fifth exemplary embodiment, the first heat exchanger component 6*a* and the second heat exchanger component 6*b* are in parallel fluid communication with one another. As the HOT FLUID flows through this heat exchanger device 6, the HOT FLUID as the Hot Fluid IN flows into the inlet header box 44*a*, then through each one of the first and second heat exchanger components 6*a* and 6*b* respectively and thereafter into the outlet header box 44*b* as the Cold Fluid OUT. Further, the horizontal first operating zone width ZW1 and the horizontal second operating zone width ZW2 are different from one another. More specifically, the horizontal first operating zone width ZW1 is smaller than the horizontal second operating zone width ZW2. Additionally, each one of the first heat exchanger component 6*a* and the second heat exchanger component 6*b* employs bare tubes formed in a serpentine configuration and are serially connected together.

Figure 14:
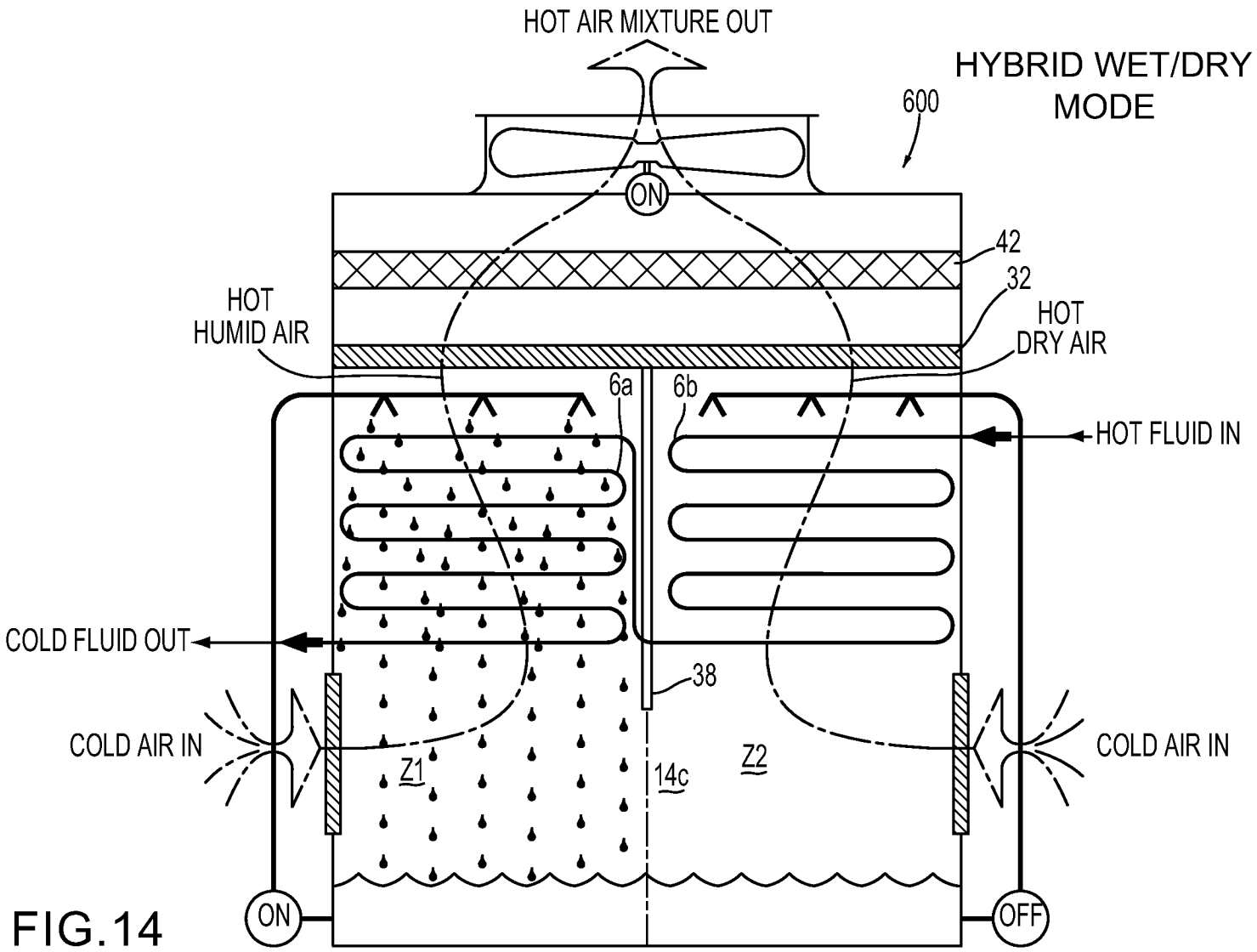
FIG. 14 is a schematic diagram of a sixth exemplary embodiment of a hybrid heat exchanger apparatus of the present invention operating in the hybrid wet/dry mode.

A sixth exemplary embodiment of a hybrid heat exchanger apparatus 600 of the present invention in the HYBRID WET/DRY mode is shown in FIG. 14. Each one of the first heat exchanger component 6*a* and the second heat exchanger component 6*b* is conventional and employs a single, continuous, bare tube 34 formed in a serpentine configuration. The first heat exchanger component 6*a* and the second heat exchanger component 6*b* are serially connected together.

Figure 15:
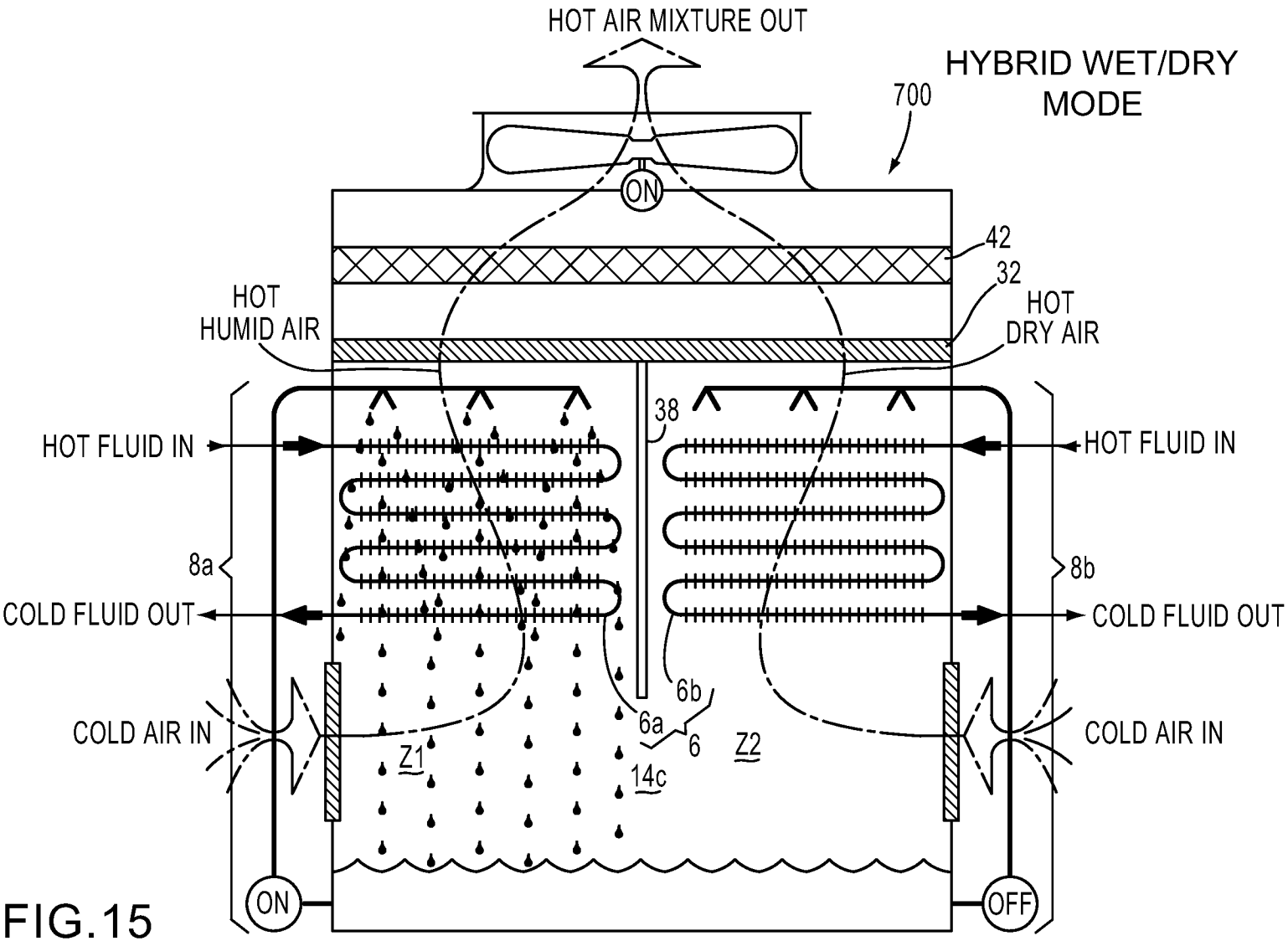
FIG. 15 is a schematic diagram of a seventh exemplary embodiment of a hybrid heat exchanger apparatus of the present invention operating in the hybrid wet/dry mode.

A seventh exemplary embodiment of a hybrid heat exchanger apparatus 700 of the present invention in the HYBRID WET/DRY mode is shown in FIG. 15. The first and second water distribution systems 8*a* and 8*b* respectfully are like the ones discussed for the first exemplary embodiment of the hybrid heat exchanger apparatus 100. Note, however, that the first heat exchanger component 6*a* and the second heat exchanger component 6*b* are in fluid isolation from one another.

Figure 16:
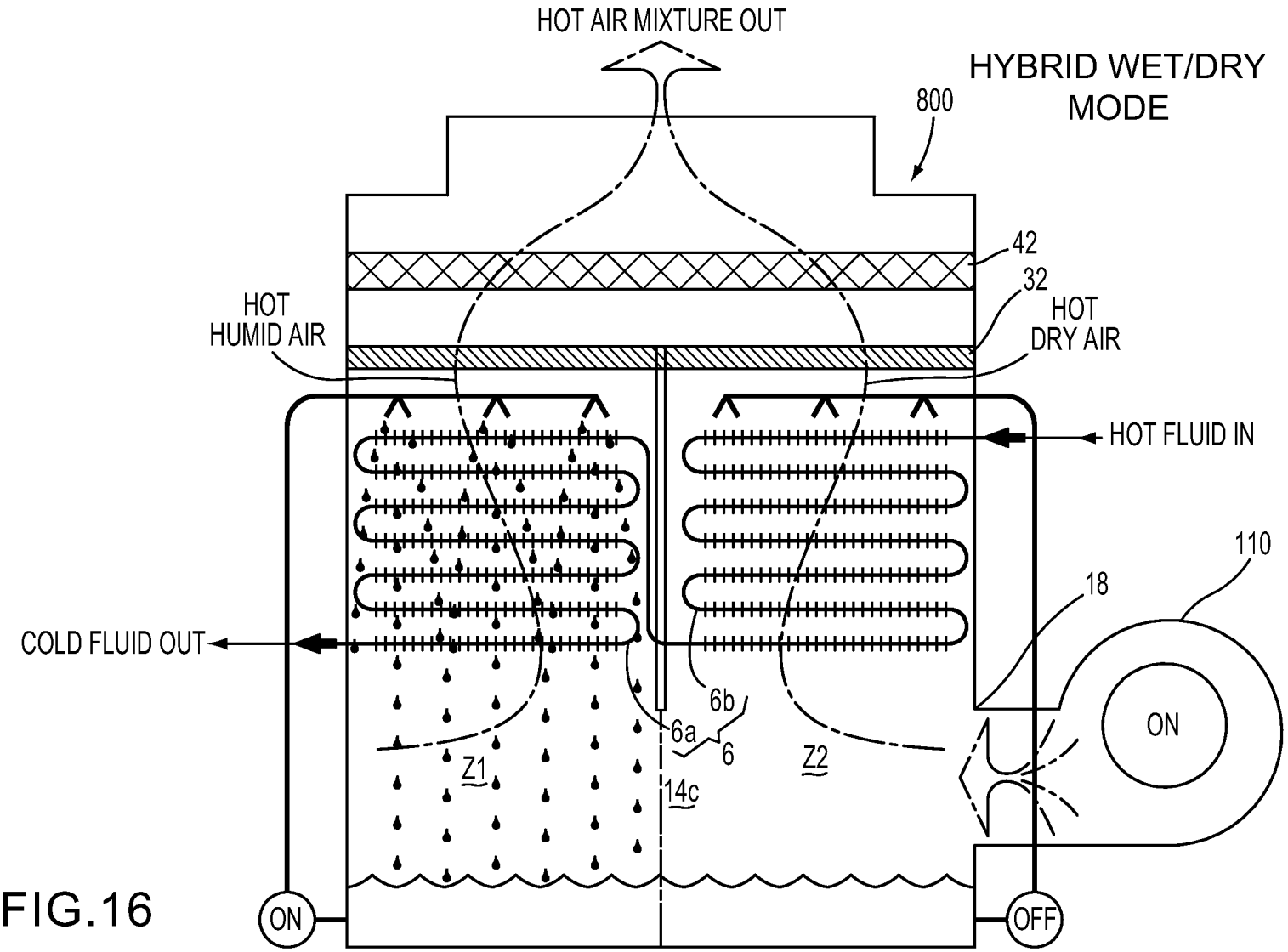
FIG. 16 is a schematic diagram of an eighth exemplary embodiment of a hybrid heat exchanger apparatus of the present invention operating in the hybrid wet/dry mode.

An eighth exemplary embodiment of a hybrid heat exchanger apparatus 800 of the present invention in the HYBRID WET/DRY mode is shown in FIG. 16. Rather than an induced-draft fan assembly 10 as represented in FIGS. 1-15 shown mounted to the container 4 adjacent the air outlet 16, a fan assembly 110, sometimes referred to as a forced draft system, is mounted at the air inlet 18 as an alternative air flow mechanism. Thus, rather than an induced draft system as represented in FIGS. 1-15, the hybrid heat exchanger apparatus 800 is considered a forced draft system.

Figure 17:
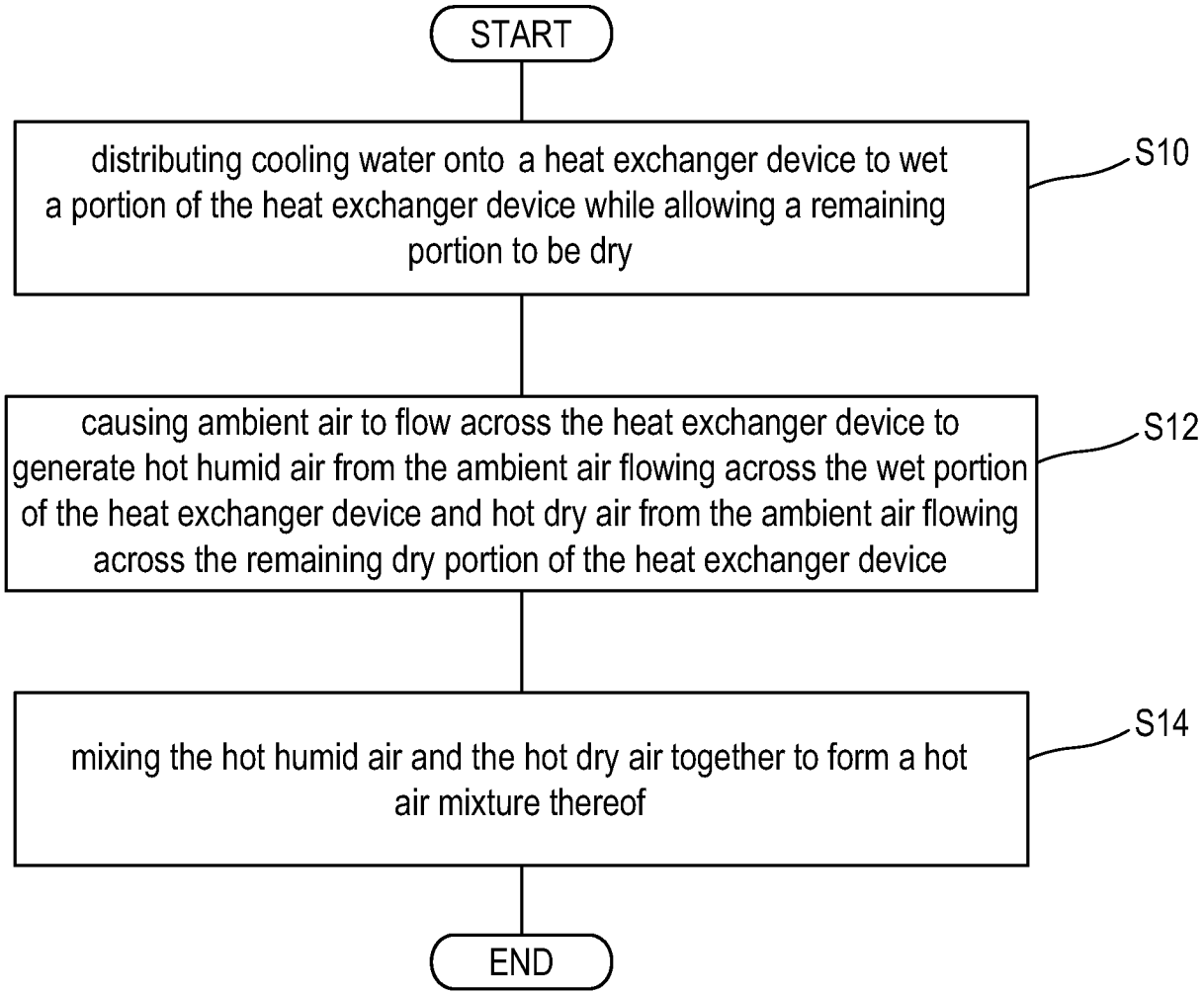
FIG. 17 is a flow diagram of a method of operating the hybrid heat exchanger apparatus of the first through eighth exemplary embodiments of the present invention.

In FIG. 17, a method for inhibiting formation of a water-based condensate from the hybrid heat exchanger apparatus of the present invention is described. The heat exchanger apparatus has the cooling water distribution system 8 and the heat exchanger device 6 as described above. The heat exchanger device has the HOT FLUID that flows therethrough, i.e., from the Hot Fluid IN to the Cold Fluid OUT. Step S10 distributes the evaporative cooling water CW from the cooling water distribution system 8 onto the heat exchanger device 6 in a manner to wet a portion of the heat exchanger device 6 (for instance, in FIG. 12) while allowing a remaining portion of the heat exchanger device 6 to be dry (for instance, in FIG. 12). Step 12 causes ambient air (represented as the Cold Air IN arrows) to flow across the heat exchanger device 6 to generate HOT HUMID AIR from the ambient air flowing across the wet portion of the heat exchanger device 6 in the first operating zone Z1 and HOT DRY AIR from the ambient air flowing across the remaining dry portion of the heat exchanger device 6 in the second operating zone Z2. Step 14 mixes the HOT HUMID AIR and the HOT DRY AIR together to form the HOT AIR MIXTURE. To enhance the method of the present invention, it might be beneficial to include yet another step. This step would provide the partition 38 that would extend vertically between the wet portion of the heat exchanger device 6 and the remaining dry portion of the heat exchanger device 6.

Ideally, the HOT AIR MIXTURE of the HOT HUMID AIR and the HOT DRY AIR exits the hybrid heat exchanger apparatus either without a visible plume P (see FIG. 2) of the water-based condensate or at least substantially without a visible plume P of the water-based condensate. However, a skilled artisan would appreciate that, when the HOT AIR MIXTURE of the HOT HUMID AIR and the HOT DRY AIR exits the heat exchanger apparatus, visible wisps W of the water-based condensate as represented in FIG. 5 might appear exteriorly of the heat exchanger apparatus without departing from the spirit of the invention.

In order to execute the method of the first through eighth embodiments of the present invention, the hybrid heat exchanger apparatus of the present invention has the heat exchanger device 6 with the hot fluid flowing therethrough. The hybrid heat exchanger apparatus of the present invention includes the cooling water distribution system 8 and the air flow mechanism such as the fan assembly 10 or 110 for causing ambient air represented as the Cold Air IN arrows to flow across the heat exchanger device 6. The cooling water distribution system 8 distributes evaporative cooling water CW onto the heat exchanger device 6 in a manner to wet a portion of the heat exchanger device 6 (for example, operating zone Z1 in FIG. 12) while allowing a remaining portion of the heat exchanger device 6 to be dry (for example, operating zone Z2 in FIG. 12). As best shown in FIG. 13, the mixing baffle structure 42 represents the means for mixing the HOT HUMID AIR and the HOT DRY AIR together to form THE HOT AIR MIXTURE. However, one of ordinary skill in the art would appreciate that induced draft-air and forced draft-air heat exchanger apparatuses have high-velocity air flowing therethrough. As a result, it is theorized that shortly after the ambient air passes across the respective ones of the wet and dry portions of the heat exchanger device, the HOT HUMID AIR and the HOT DRY AIR begin to mix. Furthermore, it is theorized that mixing also occurs as the HOT HUMID AIR and the HOT DRY AIR flow through the fan assembly 10 of the induced draft system. Thus, it may not be necessary to add the mixing baffle structure 42 or any other device or structure to effectively mix the HOT HUMID AIR and the HOT DRY AIR into the HOT AIR MIXTURE in order to inhibit formation of a plume of condensed water as the HOT AIR MIXTURE exits the container 14.

Figure 18:
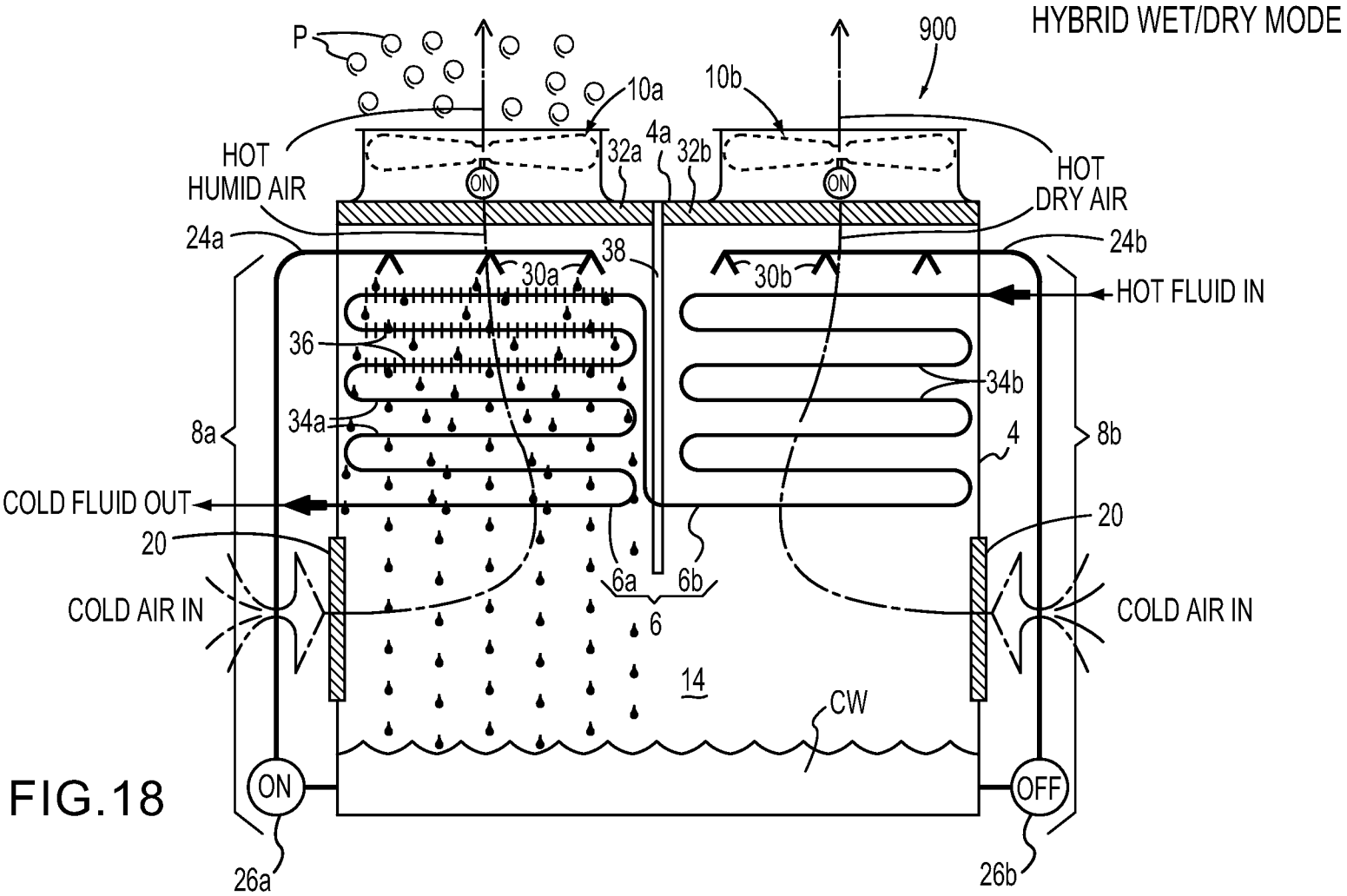
FIG. 18 is a schematic diagram of a ninth exemplary embodiment of a hybrid heat exchanger apparatus of the present invention operating in the hybrid wet/dry mode.
Figure 19:
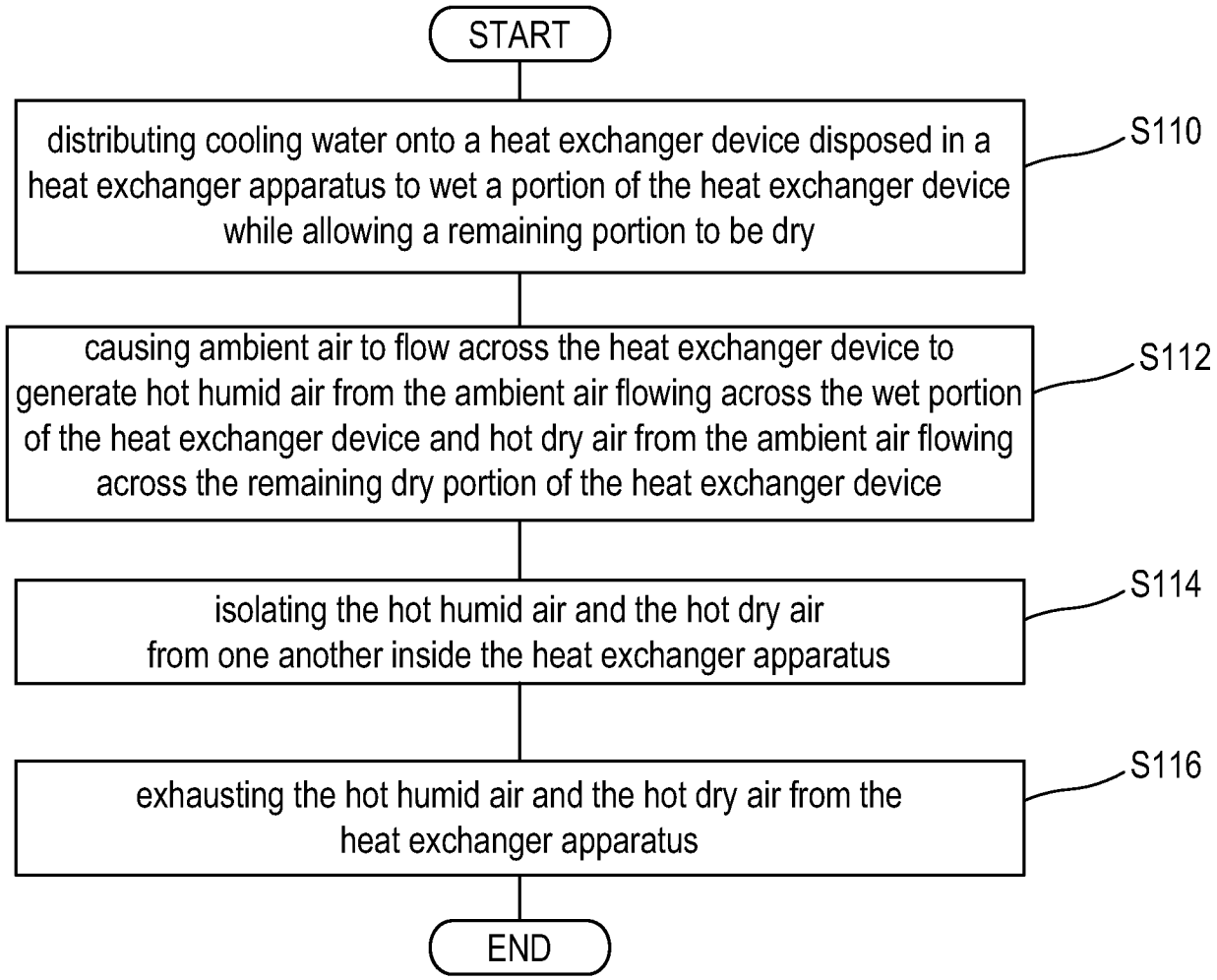
FIG. 19 is a flow diagram of a method of operating the hybrid heat exchanger apparatus of the ninth exemplary embodiment of the present invention in FIG. 18.

A ninth exemplary embodiment of a hybrid heat exchanger apparatus 900 of the present invention in the HYBRID WET/DRY mode is illustrated in FIG. 18. By way of example only, the hybrid heat exchanger apparatus 900 includes a conventional first heat exchanger component 6*a* that incorporates a combination of straight tube sections 34*a* with fins 36 and bare tube sections 34*a*, i.e, without fins and a conventional second heat exchanger component 6*b* that has all bare tube sections 34*a*. Note that the partition 38 is disposed between the first heat exchanger component 6*a* and the second heat exchanger component 6*b*, between first water distribution manifold 24*a* and the second water distribution manifold 24*b* and between a first eliminator structure section 32*a* and a second eliminator structure 32*b* and terminates in contact with the top wall 4*a* of the container 4. In effect, the partition 38 acts as an isolating panel that isolates the HOT HUMID AIR and the HOT DRY AIR from one another inside the heat exchanger apparatus 900.

Further, the hybrid heat exchanger apparatus 900 includes a first fan assembly 10*a* and a second fan assembly 10*b*. The first fan assembly 10*a* causes the ambient air to flow across the first heat exchanger component 6*a* to generate the HOT HUMID AIR from the ambient air flowing across the wetted first heat exchanger component 6*a*. The second fan assembly 10*b* causes the ambient air to flow across the second heat exchanger component 6*b* to generate the HOT DRY AIR from the ambient air flowing across the remaining dry portion of the second heat exchanger component 6*b*. Since the HOT HUMID AIR and the HOT DRY AIR are isolated from one another, the HOT HUMID AIR and the HOT DRY AIR are exhausted from the hybrid heat exchanger apparatus separately from one another. Specifically, the first fan assembly 10*a* exhausts the HOT HUMID AIR from the hybrid heat exchanger apparatus 900 and second fan assembly 10*b* exhausts the HOT DRY AIR from the hybrid heat exchanger apparatus 900.

Since the HOT HUMID AIR and the HOT DRY AIR are isolated from one another, it is possible that a plume P might form above the first fan assembly 10*a* under the appropriate atmospheric conditions. In brief, although the ninth embodiment of the hybrid heat exchanger apparatus 900 might not abate plume P, it does conserve water.

In order to execute the method of the ninth embodiment of hybrid heat exchanger apparatus 900 the present invention, the steps of distributing evaporative cooling water on the heat exchanger device and causing ambient air to flow across the heat exchanger device are identical to the method to execute the method of the first through eighth embodiments of the hybrid heat exchanger device described above. In addition thereto, to execute the method of the ninth embodiment of the hybrid heat exchanger device 900, the HOT HUMID AIR and the HOT DRY AIR are isolated from one another inside the hybrid heat exchanger apparatus and thereafter the HOT HUMID AIR and HOT DRY AIR are then exhausted from the hybrid heat exchanger apparatus as separate air-flow streams.

For the embodiments of the hybrid heat exchanger apparatus of the present invention, water conservation is achieved primarily in two ways. First, a lesser amount of cooling water CW is used when the hybrid heat exchanger apparatus is in the HYBRID WET/DRY mode than in the WET mode. For example, compare FIGS. 4 and 5. Second, a lesser amount of evaporation of the cooling water CW occurs in the HYBRID WET/DRY mode than in the WET mode. To further explain, in the HYBRID WET/DRY mode, an upstream portion of the hot fluid flowing through an upstream-side of the heat exchanger coils of the hybrid heat exchanger apparatus is cooled upstream by dry cooling and a downstream portion of the hot fluid (that has already flowed through the upstream side of the heat exchanger coils and cooled by dry cooling) is further cooled by evaporative cooling from a wetted, downstream-side of the heat exchanger coils. Thus, the embodiments of the hybrid heat exchanger apparatus are considered to have enhanced dry cooling capabilities in the HYBRID WET/DRY mode for conservation of water and, possibly, for abatement of plume.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art. For instance, although the drawing figures depict the first operating zone Z1 as a wet zone and the second operating zone Z2 as a dry zone, it is possible, with mechanical adjustments in some instances and without mechanical adjustments in other instances, it is possible that the first operating zone Z1 is a dry zone and the second operating zone Z2 is a wet zone. Further, the heat exchanger device described herein might be a condenser.

What is claimed is:

1. A heat exchanger apparatus comprising a heat exchanger device having a first heat exchanger device section and a second heat exchanger device section juxtaposed to the first heat exchanger device section with a hot process fluid flowing first through tubes of the first heat exchanger device section and then through tubes of the second heat exchanger device section and a cooling water distribution system disposed adjacent to and above the first and second heat exchanger device sections for selectively distributing cooling water onto at least one of the first and second heat exchanger device sections, the heat exchanger apparatus further comprising: a partition extending vertically between the first and second heat exchanger device sections and having a partition bottom end terminating at or below respective bottom portions of the first and second heat exchanger device sections; means for causing the cooling water distribution system to selectively distribute cooling water onto one of the first and second heat exchanger device sections in order to wet the one of the first and second heat exchanger device sections while refraining from distributing cooling water on a remaining one of the first and second heat exchanger device sections to render a remaining dry one of the first and second heat exchanger device sections; and means for causing ambient air to flow upwardly and into a first ambient airstream and a second ambient airstream, the first ambient airstream flowing upwardly across a selected cooling water wetted one of the first and second heat exchanger device sections to generate a hot humid airstream from the first ambient airstream flowing across the selected cooling water wetted one of the first heat exchanger device section and the second ambient airstream flowing upwardly across a remaining dry one of the first and second heat exchanger device sections to generate a hot dry airstream from the second ambient airstream flowing across the remaining dry one of the first and second heat exchanger device sections, wherein the partition fluidically isolates the first and second ambient airstreams from one another commencing at the partition bottom end, continues to fluidically isolate respective ones of the first and second ambient airstreams as the respective ones of the first and second ambient airstreams transform into respective ones of the hot humid airstream and the hot dry airstream and terminates fluidic isolation of the hot humid airstream and the hot dry airstream as the hot humid airstream and the hot dry airstream flow past a partition top end.

2. A heat exchanger apparatus according to claim 1, wherein the cooling water distribution system includes a water distribution manifold and a pump in fluid communication with the water distribution manifold and operative to pump the cooling water to the water distribution manifold.

3. A heat exchanger apparatus according to claim 2, wherein the cooling water distribution system includes a plurality of spray nozzles connected to and in fluid communication with the water distribution manifold, the pump operative to pump the evaporative cooling water to the water distribution manifold and through the plurality of spray nozzles.

4. A heat exchanger apparatus according to claim 1, wherein the means for causing the ambient air to flow upwardly across the first and second heat exchanger device sections is an air flow mechanism.

5. A heat exchanger apparatus according to claim 1, further comprising means for mixing the hot humid airstream and the hot dry airstream together to form a hot air mixture thereof.

6. A heat exchanger apparatus according to claim 5, wherein the means for mixing the hot humid air and the hot dry air together includes a mixing baffle structure positioned above the cooling water distribution system.

7. A heat exchanger apparatus according to claim 1, further comprising isolating means for entirely isolating the hot humid airstream and the hot dry airstream from one another as the hot humid airstream and the hot dry airstream flow inside the heat exchanger apparatus.

8. A heat exchanger apparatus according to claim 7, wherein the means for causing the ambient air to flow upwardly across a wet one of the first and second heat exchanger device sections to generate the hot humid airstream is a first air flow mechanism and for causing the ambient air to flow upwardly across a dry one of the first and second heat exchanger device sections to generate the hot dry airstream is a second air flow mechanism.

9. A heat exchanger apparatus according to claim 8, further comprising means for exhausting the hot humid air and the hot dry air from the heat exchanger apparatus, wherein the exhaust means is the first air flow mechanism for exhausting the hot humid airstream from the heat exchanger apparatus and is the second air flow mechanism for exhausting the hot dry airstream from the heat exchanger apparatus.

* * * * *